US007469749B2

(12) United States Patent
Folk

(10) Patent No.: US 7,469,749 B2
(45) Date of Patent: Dec. 30, 2008

(54) MOBILE SNUBBING SYSTEM

(75) Inventor: Steve Folk, Sherwood Park (CA)

(73) Assignee: Live Well Service, A Division of Precision Drilling Corporation, Calgary (CA)

( * ) Notice: Subject to any disclaimer, the term of this patent is extended or adjusted under 35 U.S.C. 154(b) by 153 days.

(21) Appl. No.: 11/677,561

(22) Filed: Feb. 21, 2007

(65) Prior Publication Data

US 2007/0193749 A1 Aug. 23, 2007

Related U.S. Application Data

(60) Provisional application No. 60/766,977, filed on Feb. 22, 2006.

(51) Int. Cl.
*E21B 19/08* (2006.01)

(52) U.S. Cl. ..... 166/379; 166/77.4; 166/380; 175/85

(58) Field of Classification Search ..... 166/77.4, 166/379, 380; 175/85
See application file for complete search history.

(56) References Cited

U.S. PATENT DOCUMENTS

| | | | | |
|---|---|---|---|---|
| 3,177,944 | A * | 4/1965 | Knights | 166/77.53 |
| RE26,284 | E * | 10/1967 | O'Neill et al. | 175/57 |
| 3,708,024 | A * | 1/1973 | Back | 175/52 |
| 4,119,297 | A * | 10/1978 | Gunther | 254/29 R |
| 4,265,304 | A * | 5/1981 | Baugh | 166/77.2 |
| 4,290,495 | A * | 9/1981 | Elliston | 175/85 |
| 4,336,840 | A * | 6/1982 | Bailey | 166/77.4 |
| 4,547,109 | A * | 10/1985 | Young et al. | 414/22.53 |
| 6,161,358 | A * | 12/2000 | Mochizuki et al. | 52/651.05 |
| 6,554,075 | B2 * | 4/2003 | Fikes et al. | 166/379 |
| 7,140,453 | B2 | 11/2006 | Ayling | |
| 2005/0269133 | A1 * | 12/2005 | Little | 175/52 |
| 2006/0260844 | A1 * | 11/2006 | Patton et al. | 175/52 |

FOREIGN PATENT DOCUMENTS

WO 99/35367 7/1999

OTHER PUBLICATIONS www.higharcticwellcontrol.com/standAlone.asp; Stand Alone Snubbing Systems; High Arctic Energy Services Inc.; accessed on Feb. 16, 2006.

www.snubsecure.com/equipment.htm; Snub Secure Inc.; accessed on Feb. 6, 2006.

www.higharcticwellcontrol.com/HighArcticDocs/RigAssist112902.pdf; Rig Assist Snubbing System; Jun. 17, 2003.

* cited by examiner

*Primary Examiner*—Hoang Dang
(74) *Attorney, Agent, or Firm*—Sean W Goodwin

(57) ABSTRACT

A mobile snubbing system and method of operation transports a snubbing unit to a wellhead on a mobile platform. The snubbing unit is supported by a frame pivotable about a wellhead end of the platform for aligning the snubbing unit with the wellhead. A pipe handler boom is operable between a platform position for loading and off-loading tubulars at an open side of the platform and a second snubbing position for loading and off-loading tubulars at the top end of the snubbing unit. The boom can be telescopic for extending to the top of the snubbing unit and can be automated after learning tubular manipulation at the wellhead. Pipe racks can be deployable from the open side of the platform and an indexer and kicker in the platform enables loading and off-loading tubulars at the pipe handler.

36 Claims, 37 Drawing Sheets

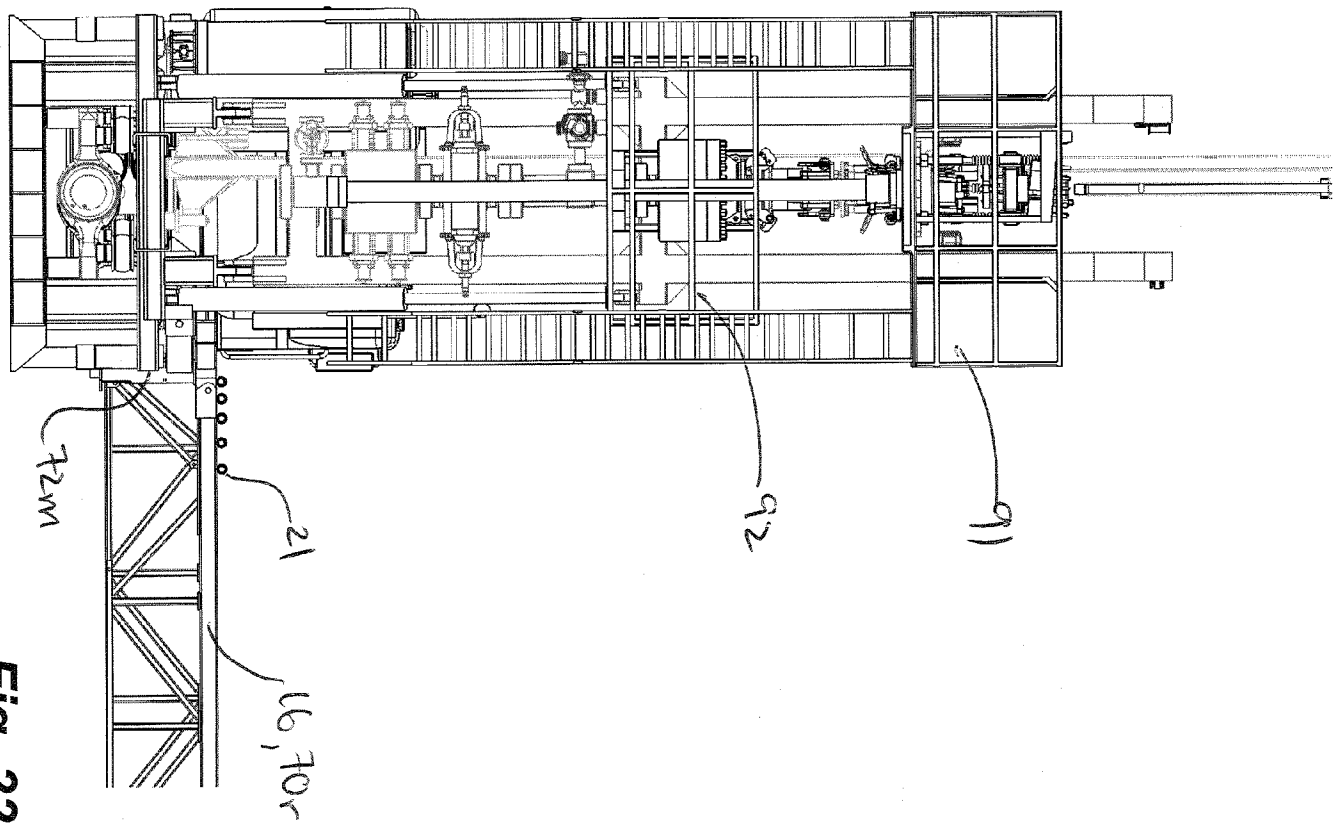
Fig. 22
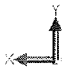

MOBILE SNUBBING SYSTEM

CROSS REFERENCE TO RELATED APPLICATIONS

This application is a regular U.S. patent application claiming priority of U.S. Provisional Patent application Ser. No. 60/766,977 filed Feb. 22, 2006, the entirety of which is incorporated herein by reference.

FIELD OF THE INVENTION

The present invention relates to snubbing systems and snubbing operations requiring minimum extraneous equipment, personnel and incorporating safety aspects including BOP stack testing and repositioning personnel out of harms way.

BACKGROUND OF THE INVENTION

Snubbing units are known in the oil and gas industry for facilitating access to a well which is under pressure including, for example, well operations such as well completions. A snubbing unit manipulates various tubular components such as pipe, tubing, and bottom hole assemblies (BHA) in and out of a well while controlling the well under pressure. However, wellhead components are not conventionally equipped to deal with the manipulation of tubular components therethrough. Therefore, additional hardware, in cooperation with the snubbing unit, provides additional sealing and physical handling components, which are required to handle tubular components, these being either heavy tubular components which tend to fall into the well, termed "pipe heavy", or which can be upwardly energized for ejection from the well under pressure, termed "pipe light". Generally, a snubbing unit employs stationary (lower) and traveling (upper) slip assemblies, opposingly oriented, to releasably and controllably shift tubulars into and out of the well through a wellhead despite the possibility of either heavy tubular loads, which urge the tubular to fall into well, or the pressure-generated forces on the tubulars, which urge the tubular out of the well. The snubbing unit is installed above an existing wellhead seal and incorporates its own seals to seal the tubulars as they are introduced or removed from the wellhead.

Snubbing units are rigged up to perform their required operation and rigged out thereafter. Most conventional snubbing units fall into either rig-assist or self-contained units. Rig-assist snubbing units are typically snubbing units that are pivotally mounted to a truck and require assistance by an onsite service rig so as to winch them upright, pivoting from the truck, to a snubbing position over the wellhead. Self-contained units are typically rig-assist snubbing units, transported to site on a truck and lifted into position, over the wellhead, by a separate crane unit. During operations, self-contained snubbing units do not require the assistance from an on-site rig. For both rig-assist and self-contained snubbing units, a variety of other site equipment is required including catwalks, pipe tubs, and pipe-handlers. All of the required equipment results in large capital equipment costs, a large footprint onsite, extra crew and larger operating costs.

Further, conventional snubbing operations require personnel to be positioned adjacent the area for tubing connections, placing personnel at the highest risk, should there be an upset or release.

There is a demonstrated need for a system utilizing a minimum of extraneous equipment, personnel and increased safety for those personnel operating snubbing units.

SUMMARY OF THE INVENTION

An embodiment of the snubbing system of the present invention comprises a mobile transport platform having substantially all of the equipment mounted thereon as required for snubbing operations. The system comprises a snubbing structure pivotally mounted at the rear of an equipment bed of a truck. The truck comprises the equipment bed and a truck cab-over arrangement, which aids in maximizing the bed area length and also aids in providing front-loaded counterweight to the bed load. The truck is preferably a tridem drive and tandem steer with the cab in front of the steering wheels or to one side so as to meet dimensional and weight requirements for road transport.

The bed can comprise a dual rail frame, supporting the snubbing structure, ground engaging leveling and stabilization jacks, pipe racks, an indexing and kickout assembly and a pipe handler including a programmable robotic, pivoting pipe-lifting handler arm and automated tongs. Automation of the pipe handling and tongs permits the operators to be located away front the release point for well fluids or pipe. A telescoping pipe handler enables greater range of motion required to adapt between a truck of limited length and the heights required for snubbing.

The transport further comprises onboard hydraulics and hydraulic tanks. A pressure integrity testing system is also provided, comprising test pumps, a test plug and flange, and an environmentally safe antifreeze supply as test fluid.

In operation, a system according to the present embodiment and an additional truck, bearing a generator set and a dog house for personnel comfort, is preferred.

The rear of the truck bed is positioned adjacent a wellhead for rig up. At some point, the snubbing structure is pressure tested before erecting. The stabilization jacks are deployed and the subbing structure is erected or raised, pivoting about the rear of the bed (first end of the frame) to align over the wellhead. The snubbing structure is supported for pivotal actuation upon two beams, each of which is pivotally connected at their first, proximal end to the bed and whose second distal ends are releasably bridged by an axis beam member employed for raising and lowering, but which can be displaced or removed to form an open side for the handling of pipes therethrough. Pipe rack arms, which are shipped supported parallel and adjacent along one side of the equipment bed, are pivotally connected at either end of the equipment bed and are pivotally deployed to a substantially perpendicular arrangement with respect to the equipment bed. Jacks, such as hydraulic-actuated jacks at distal ends (second ends) of the rack arms can introduce a small slope towards the equipment bed for urging pipe to roll to the equipment bed or a small slope away from the equipment bed for off-loading pipe. In the equipment bed, the indexer/kicker stores about seven lengths of tubing at deck level and indexes one at a time up into the pipe handler for running in pipe. When running in pipe, the pipe handler grabs the pipe from the bed and raises it to the top of the snubbing unit.

Once ready the operator starts the operational program, in the second operational state, where the pipe handler robotically stabs the pipe into the collar of the previous joint of pipe. The pipe connection is then made up remotely with the power tongs. Once the connection is made, the pipe handler is released and it automatically returns to the bed and retrieves the next joint of pipe and the process is repeated. If tripping out pipe, the pipe handler grabs the joint of pipe at the top of the snubbing unit and holds it while the tongs rotate out the joint. The handler then lays it down on the bed where the kicker sends it off the equipment bed onto the pipe racks.

In a broad aspect of the invention, a mobile snubbing system for manipulating tubulars into and out of a wellhead through a wellhead axis comprises a snubbing unit having a snubbing axis, a top end and a bottom end adapted to connect to the wellhead; a mobile transport platform for delivering the snubbing unit to the wellhead, the platform having a front end and a rear end and an open side; a frame having a first end mounted pivotally at the rear end of the platform and a second end, the frame being operable between a first shipping position, wherein the snubbing unit is supported by the frame with the snubbing axis generally horizontal, and a second operational position, wherein the frame is pivotally erected about the first end of the frame for aligning the snubbing axis of the snubbing unit with the wellhead axis of the wellhead for connection thereto; and a pipe handler having a boom pivotally mounted at a first end of the boom adjacent the rear end of the platform wherein when the frame is in its second operational position, the boom is operable between a first platform position substantially parallel to the platform for loading and off-loading tubulars at the open side, and a second snubbing position, wherein the boom is pivotally erected for loading and off-loading tubulars at the top end of the snubbing unit. Alternate embodiments include automating the pipe handling, operating an extendible pipe hander, vertically adjusting the snubbing unit relative to the frame prior to connection to the wellhead, implementing pipe racks deployable from the open side of the platform and an indexer and kicker in the platform for loading and off-loading tubulars at the pipe handler.

The snubbing system enables a method for snubbing a well comprising: supporting a snubbing unit in a frame which is supported by a mobile platform; transporting the frame and snubbing unit to the wellhead by the mobile platform; pivoting the frame about a wellhead end of the platform for suspending a snubbing axis of the snubbing unit in alignment with the wellhead axis; connecting the snubbing unit to the wellhead; loading and off-loading tubulars from and open side of the platform; and pivoting a pipe handler from the platform for handling the tubulars between a platform position for loading and off-loading tubulars and a snubbing position for loading and off-loading tubulars at the snubbing unit for snubbing the well.

In an alternate embodiment, the pipe handler is automated by first manually guiding a tubular between the platform and the snubbing unit for learning a movement of tubulars for snubbing the well; and thereafter automatically pivoting tubulars between the platform and the snubbing unit for snubbing the well.

BRIEF DESCRIPTION OF THE DRAWINGS

FIG. 18A illustrates the axis beam member in the closed position;

FIG. 18B illustrates the axis beam member of FIG. 18A with the pin released and the beam being pivoted to the open position;

FIG. 18C illustrates the axis beam member of FIG. 18A in the open position;

FIG. 18D illustrates of the other side of the axis beam member of FIG. 18A;

FIG. 22 is a partial rear elevational view with the rear leveling stand lowered to engage the ground (ground omitted);

DETAILED DESCRIPTION OF THE PREFERRED EMBODIMENTS

Generally

Figure 1:
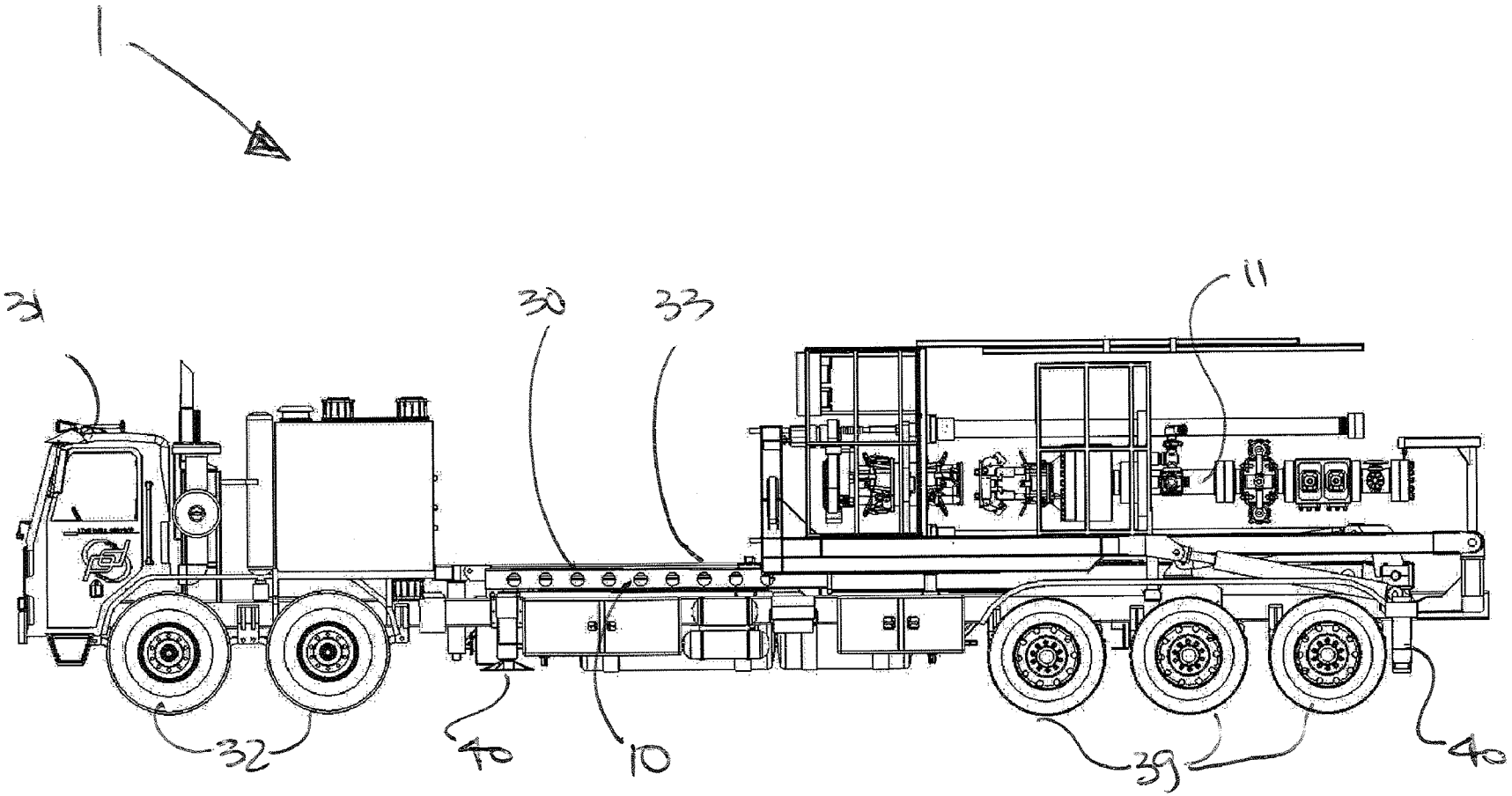
FIG. 1 is a side view of an embodiment of a mobile snubbing system, in travel mode, with the snubbing unit pivoted to the shipping position within the maximum road height, width, length, and weight allowance.
Figure 2:
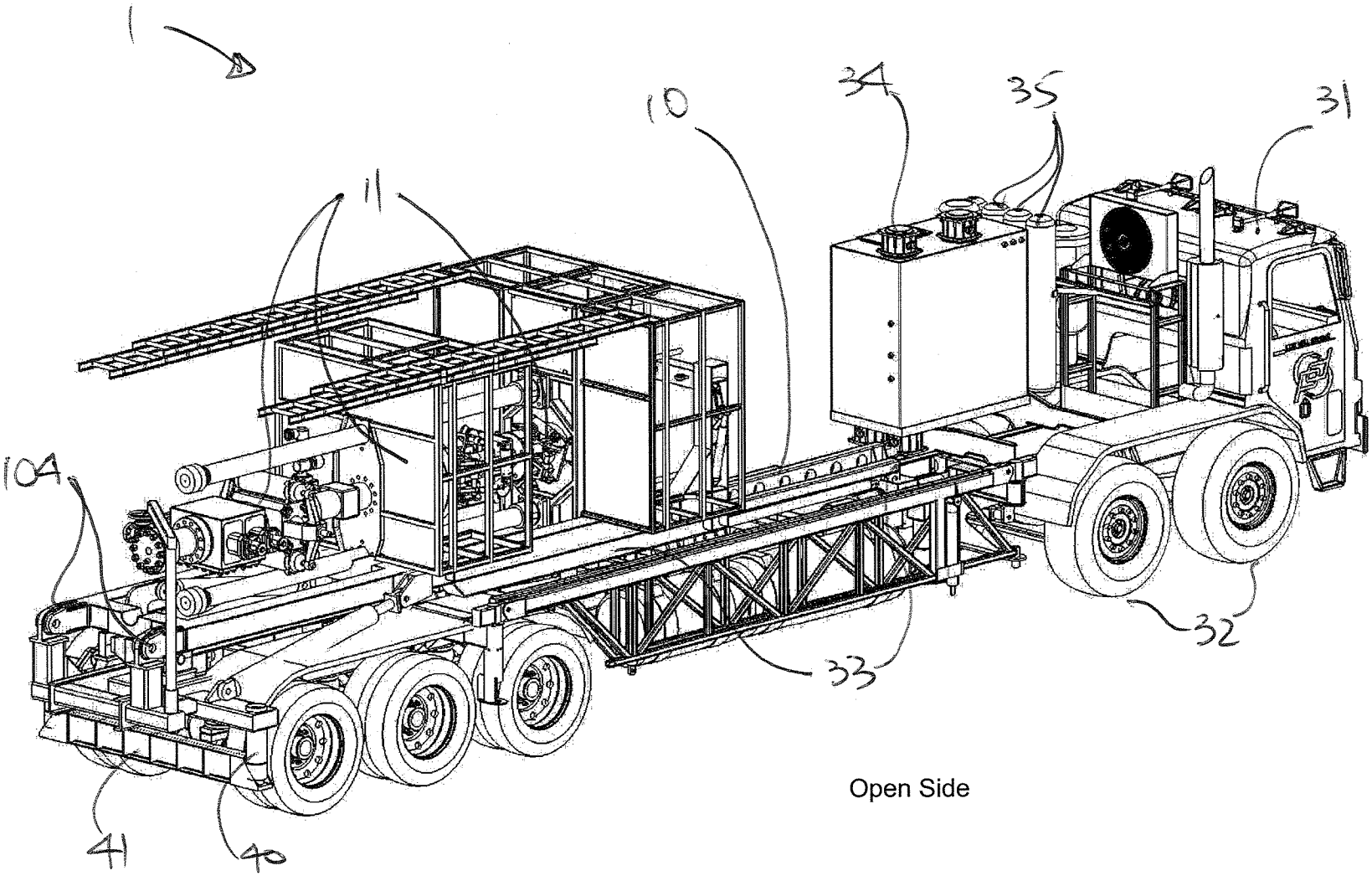
FIG. 2 is a perspective view the embodiment of FIG. 1 viewed from the open side with the pipe rack arms stowed.

As shown in FIGS. 1 and 2, a mobile snubbing system 1 comprises a mobile platform 10 supporting a snubbing unit 11 which can be transported to a site.

Figure 3:
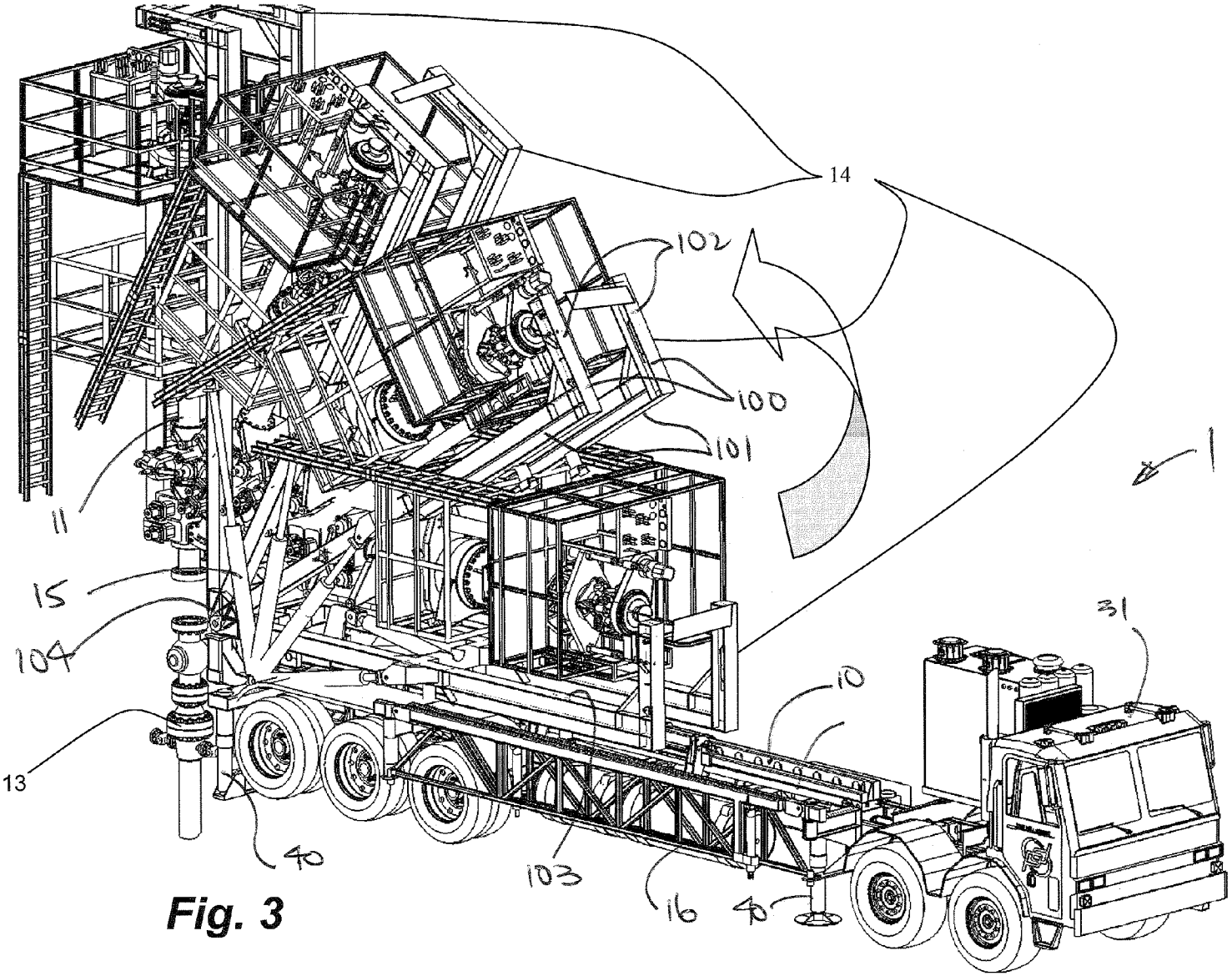
FIG. 3 is a perspective view of the embodiment of FIG. 1 viewed from the open side, with the snubbing unit being shown in various incremental stages of being raised into the second operational position over a wellhead.

With reference to FIG. 3, the snubbing unit 11, supported in a frame 14, is pivotally erected from a wellhead end or rear of the platform 10 and over a wellhead 13 using an actuator 15 acting between the frame 14 and the mobile platform 10.

Figure 4A:
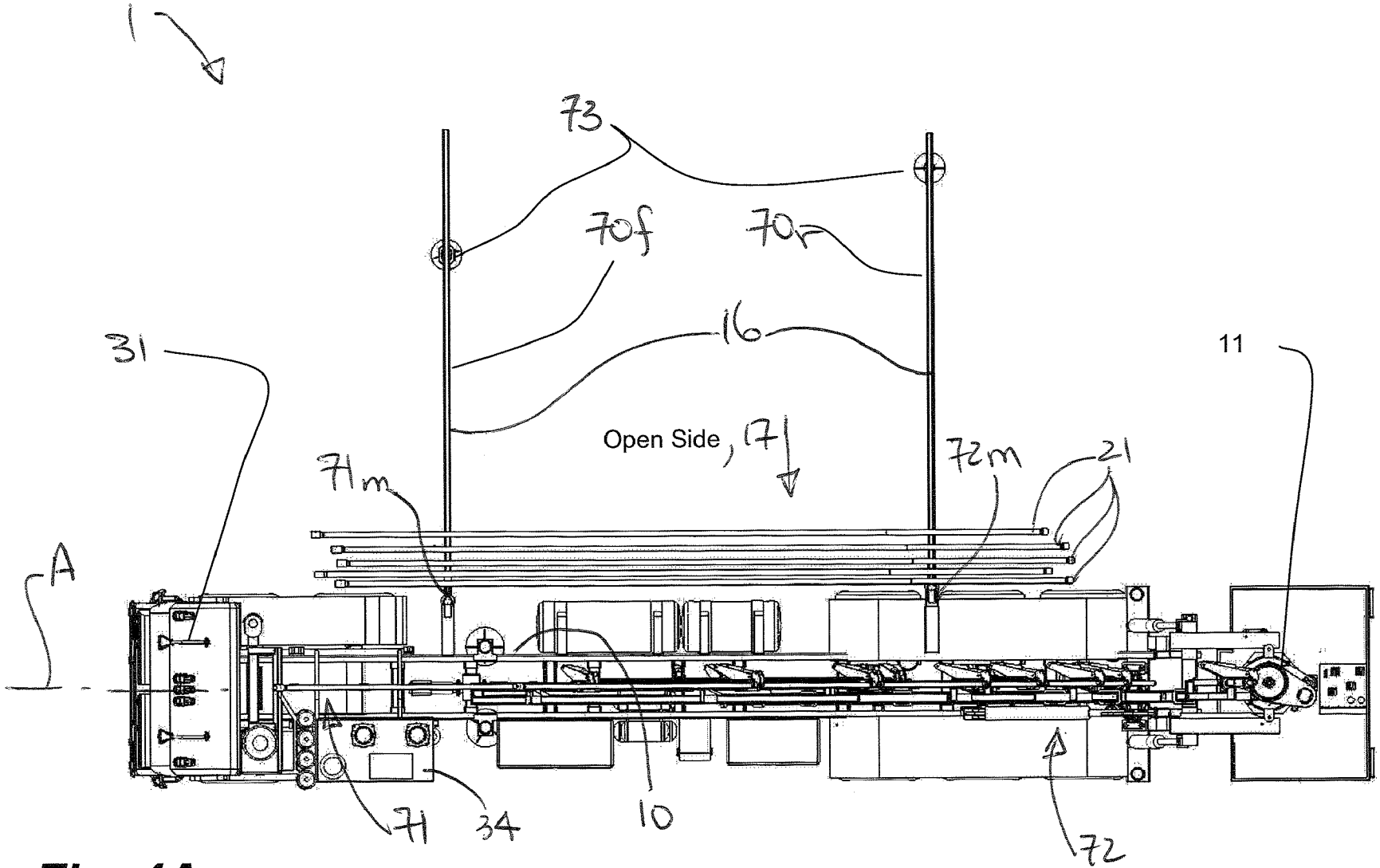
FIG. 4A is a plan view of the invention, in operational mode, with the snubbing unit in place over the wellhead and the pipe rack arms extended and with the pipe handler in place in various incremental stages of FIG. 5.
Figure 4B:
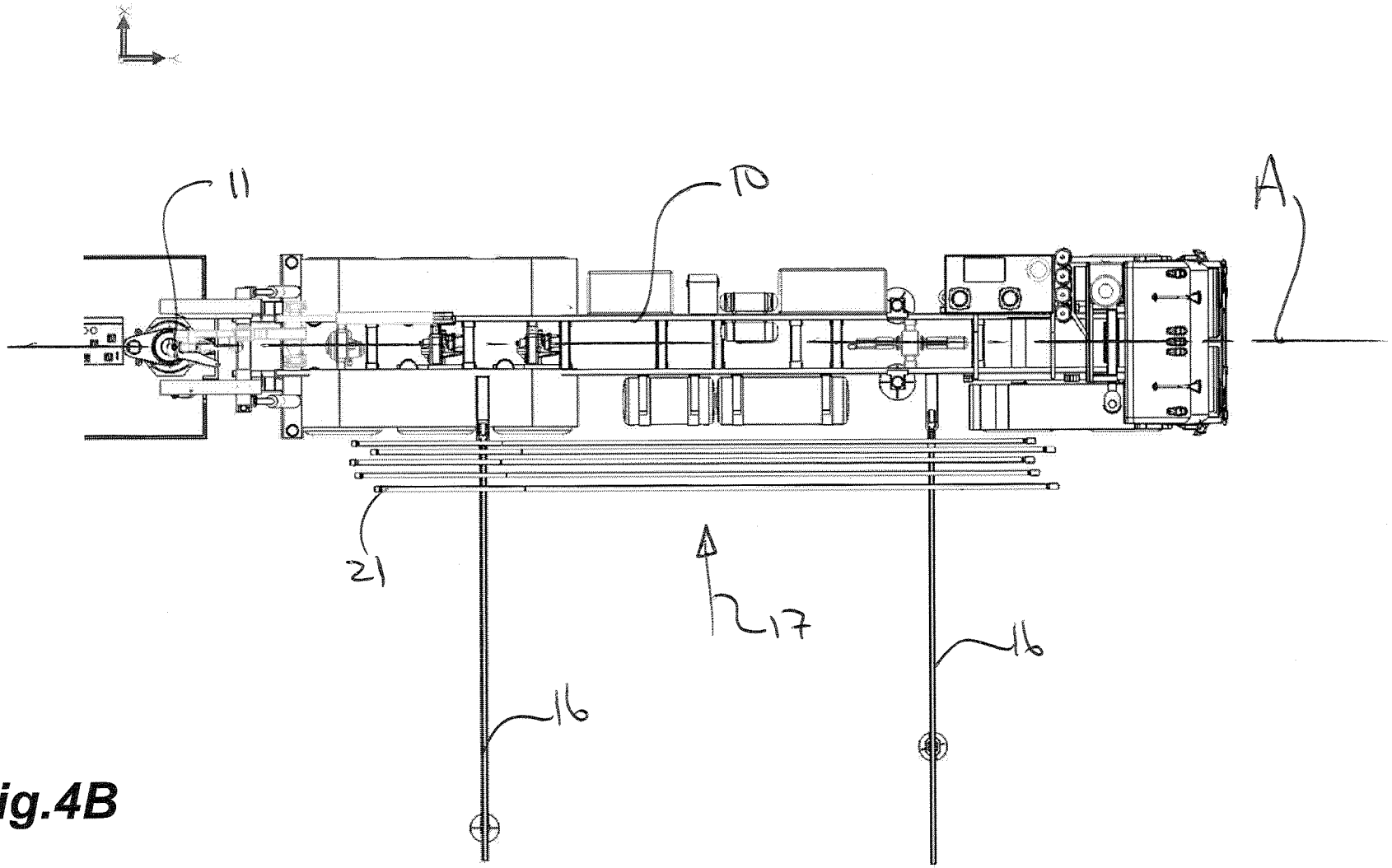
FIG. 4B is a plan view of the invention of FIG. 4A with the pipe handler removed for clarity.
Figure 5:
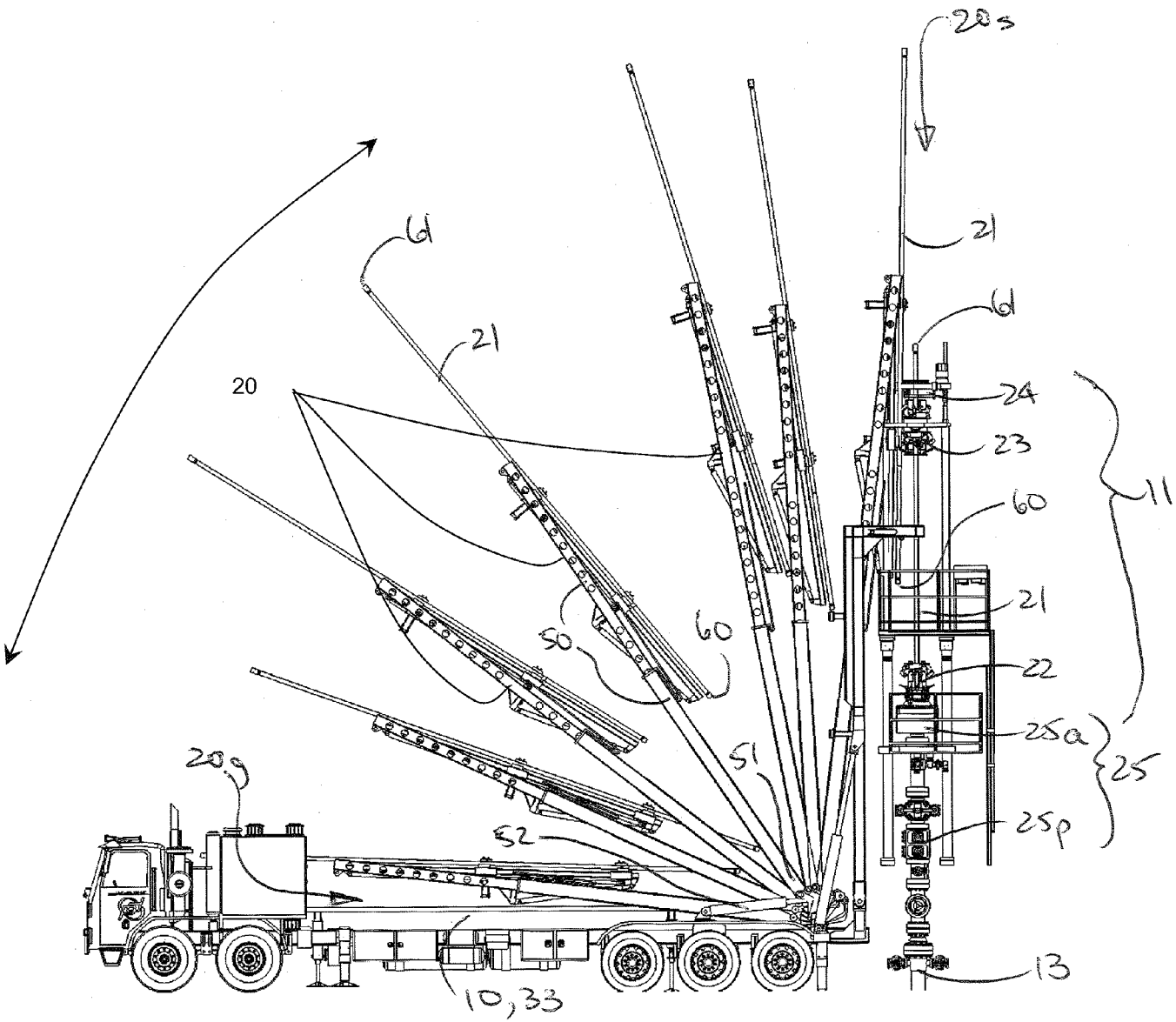
FIG. 5 is a side view of the embodiment of FIG. 4 with the pipe handler being shown in various incremental stages of raising a tubular from the bed to above the snubbing unit.
Figure 6:
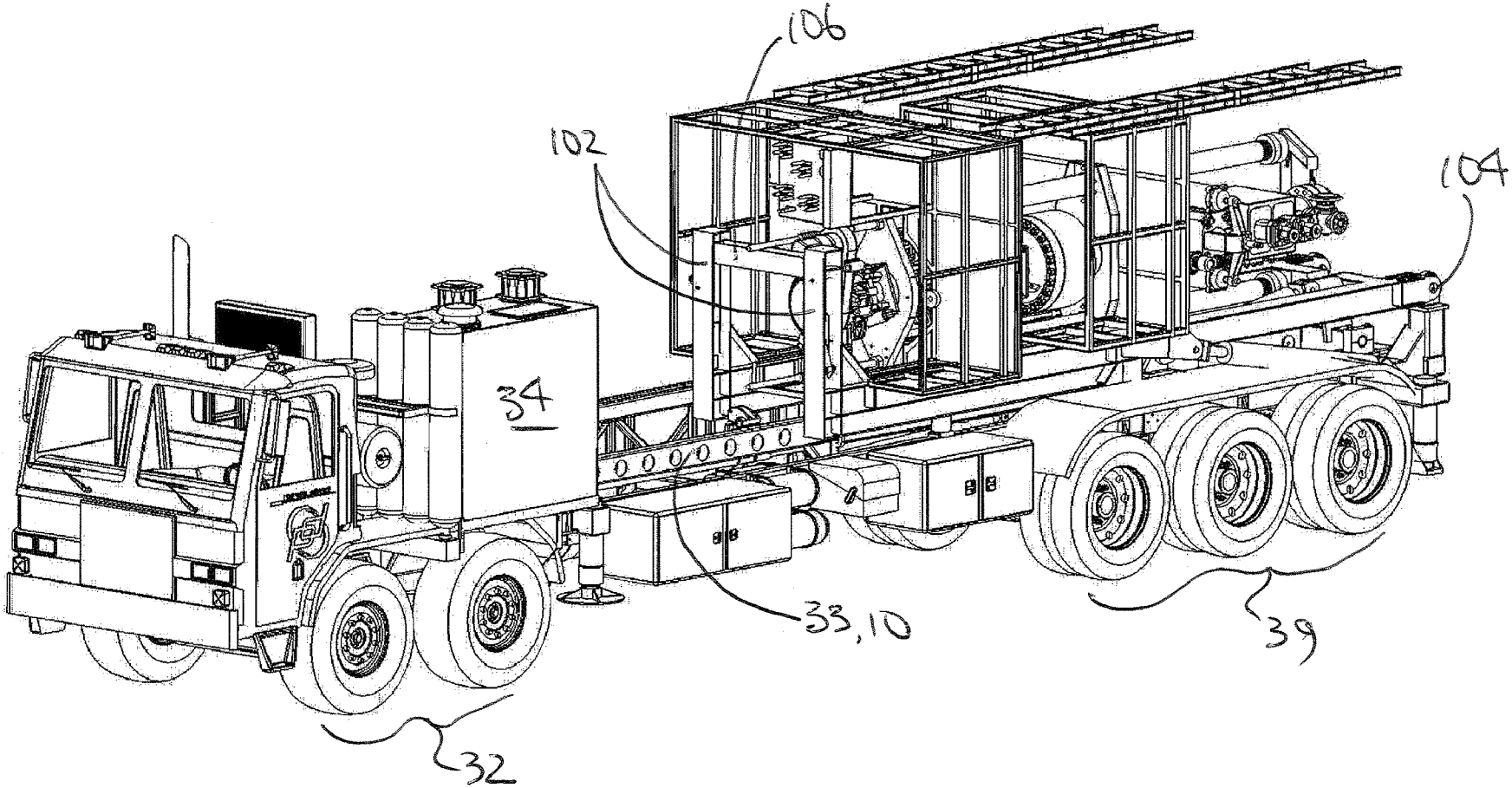
FIG. 6 is a perspective view of an embodiment of the mobile snubbing system in travel mode illustrating the auxiliary equipment side.
Figure 7:
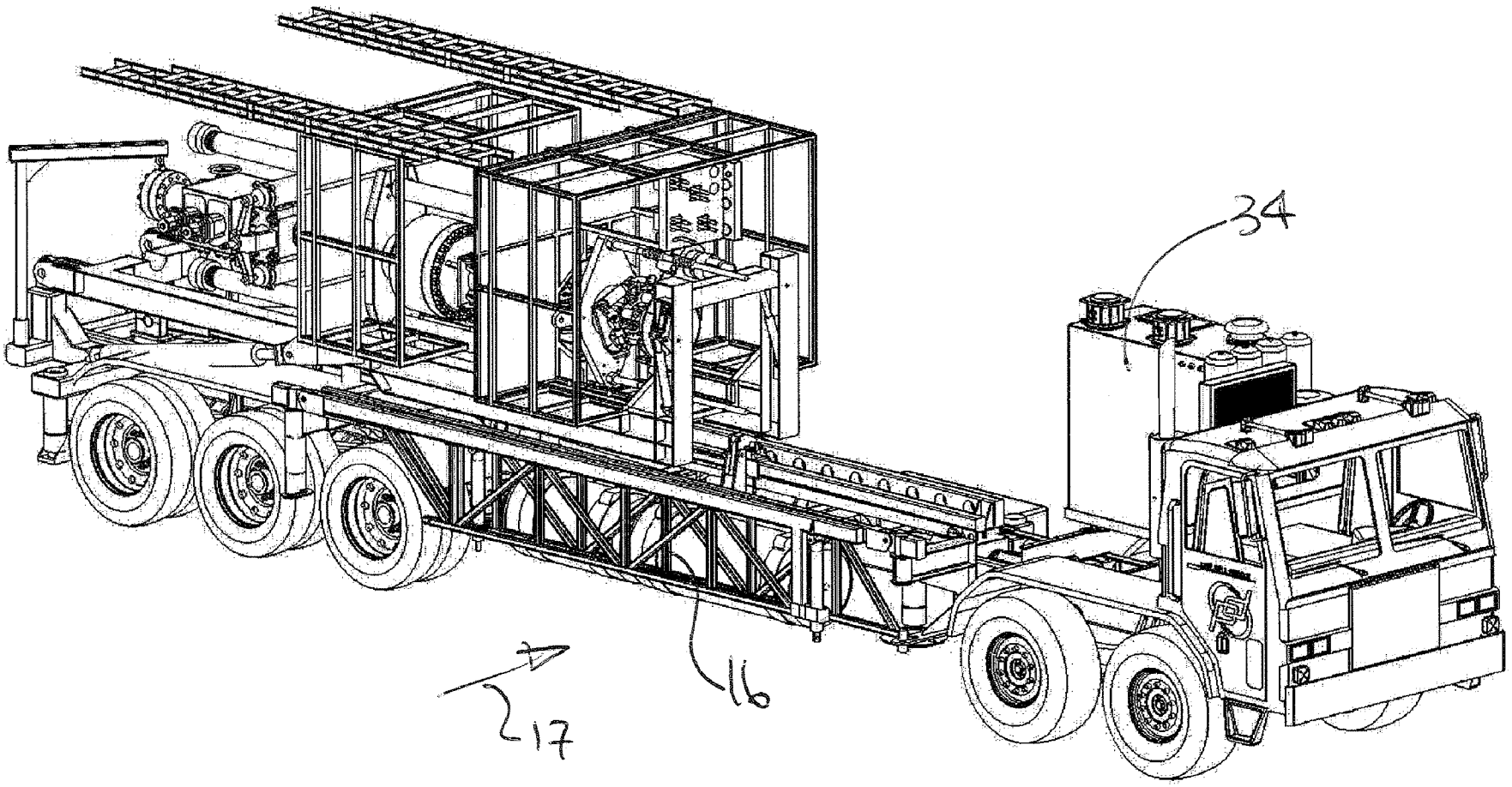
FIG. 7 is a perspective view of FIG. 6 illustrating the open side for handling tubulars.
Figure 8:
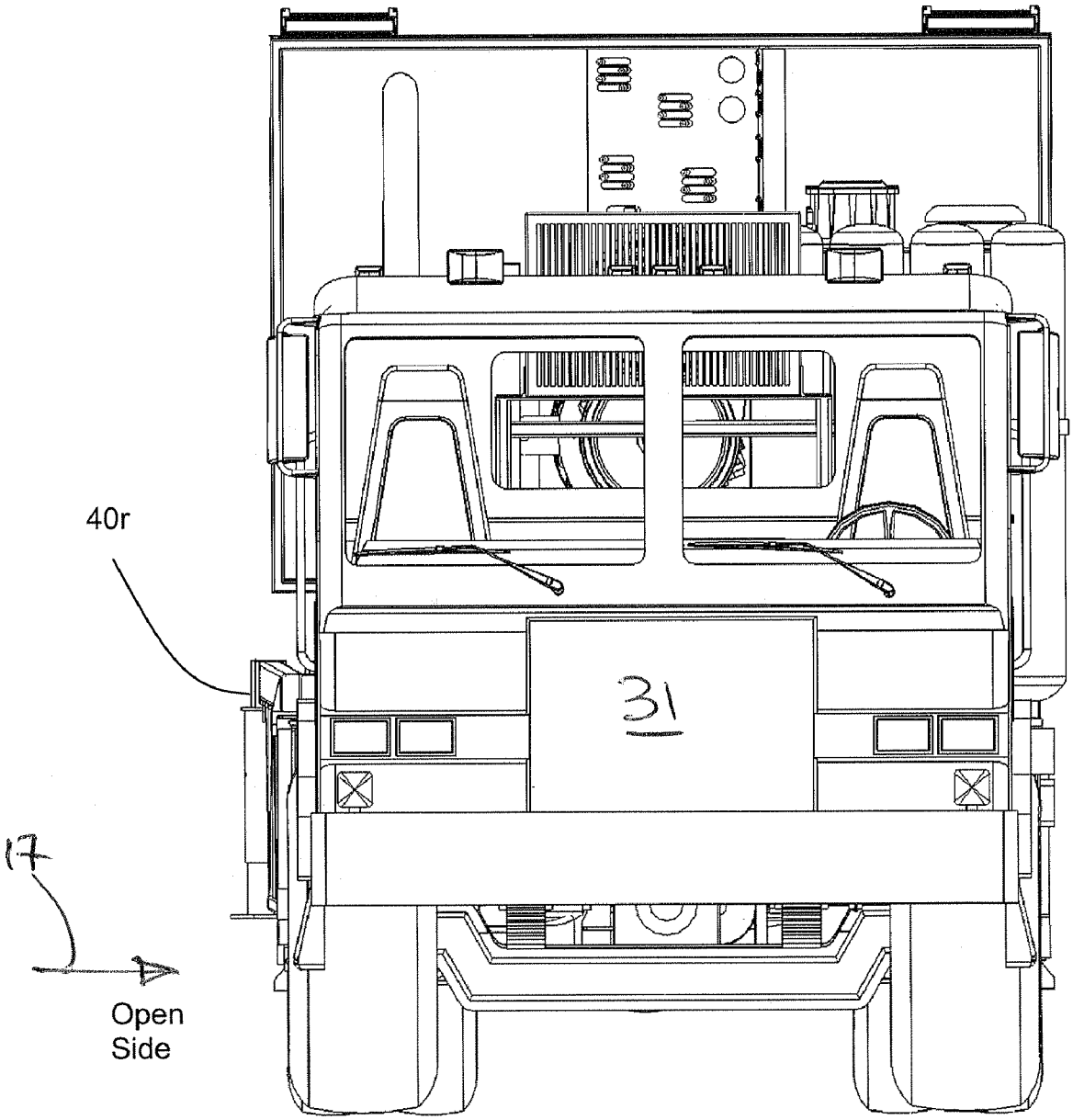
FIG. 8 is a front view illustrating the shipment within maximal permissible roading dimensions and the stowed pipe rack arms on the open side. The rear (second) pipe rack arm is shown with the pivot end extended to clear the wheels in preparation for pivoting out.
Figure 9:
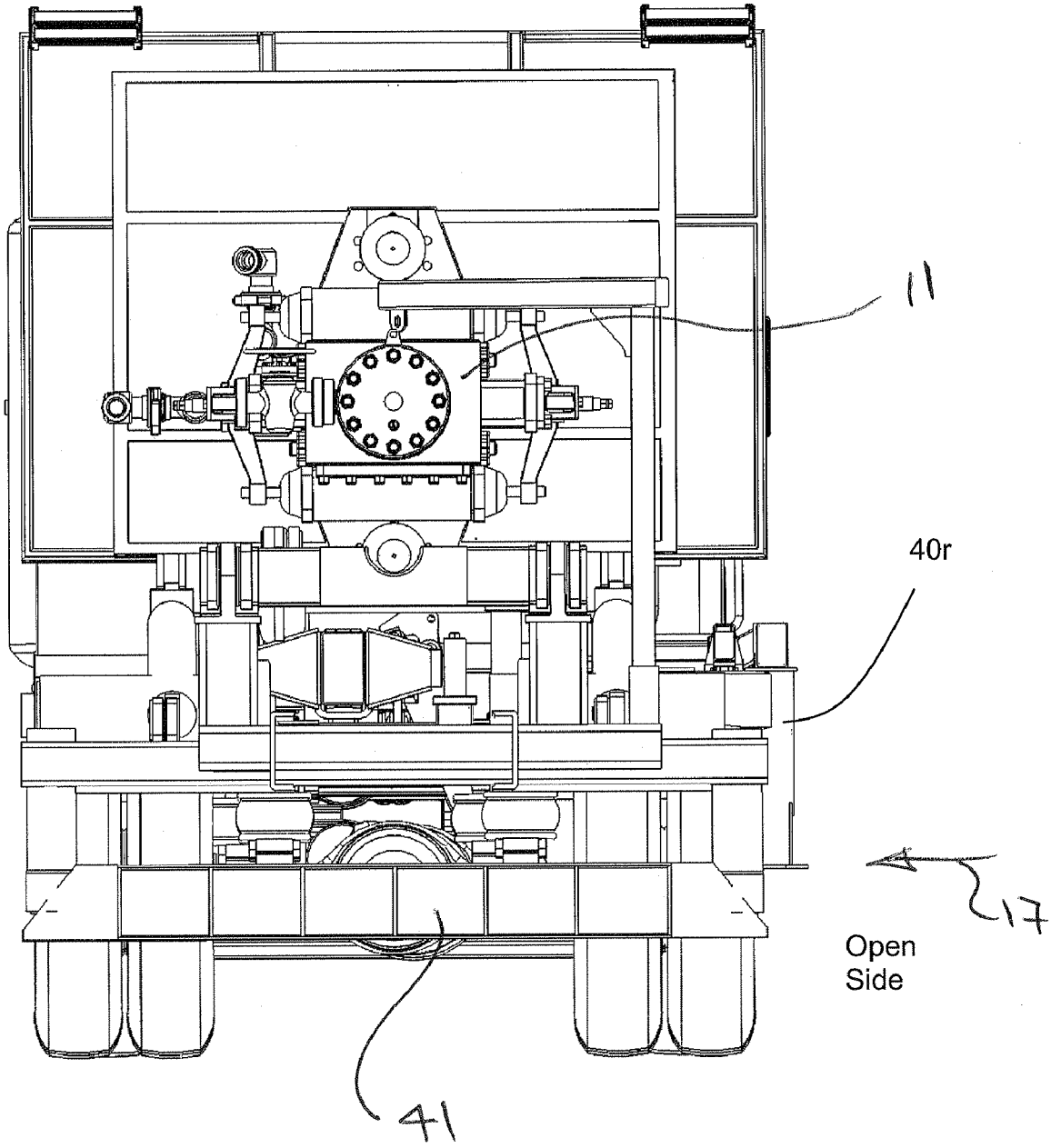
FIG. 9 is a rear view illustrating the snubbing unit with pressure testing flange and nubbin bolted in place for pressure test and transport mode. As in FIG. 9, the rear (second) pipe rack arm is shown with the pivot end extended to clear the wheels in preparation for pivoting out.
Figure 10:
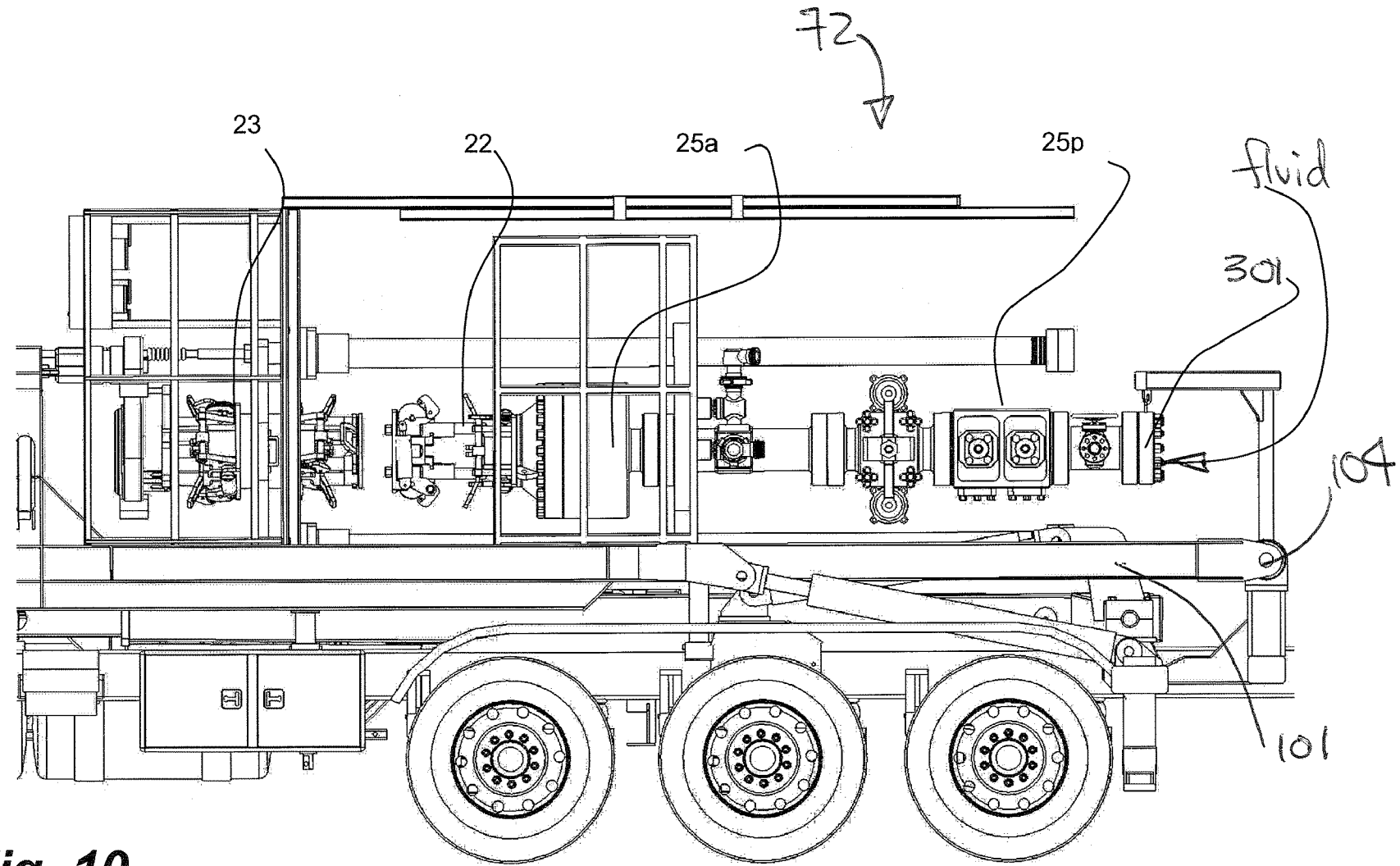
FIG. 10 is a partial side view illustrating the snubbing unit over the tridem drive and raising actuators.

Turning to FIGS. 4A and 4B, pipe racks 16 can be pivotally extended laterally from the platform 10 for the loading and off-loading of tubulars 21 from an open side 17 of the platform 10. In FIG. 5, an integrated pipe-handler 20 can move pipe or tubulars 21 between the mobile platform 10 and the snubbing unit 11. In embodiments of the invention, the pipe-handler 20 can be telescopically actuated for adapting to length constraints imposed the mobile platform 10 and by the extended reach requirements for delivering tubulars in and out of the top of the snubbing unit 11. A known snubbing unit 11 is shown in more detail in FIGS. 5, 29, 30A and 30B. The snubbing unit 11 generally employs lower, stationary lower slip assemblies 22 and upper, traveling slip assemblies 23 supported on a traveling plate 26 which are accompanied by tongs 24 for making and breaking joints between successive lengths of tubulars 21. Below the lower slip assemblies 22 are blow out preventors (BOP) 25 which are adapted for connection to the wellhead 13.

Truck Bed and Pipe Handler

With reference again to FIGS. 1 and 4B, the mobile platform 10 is a truck having a driver's cab 31 over front tandem steering wheels 32 and a truck equipment bed 33 or deck extending rearwardly therefrom supported on tridem rear drive wheels 39, the bed 33 having a substantially central axis A. A maximum road allowance length can be most usefully exploited in this format. As discussed below, the snubbing unit 11 is supported and pivotally mounted to the bed 33.

A hydraulic reservoir or tank 34 is mounted offset from the axis A and positioned about or over the steering wheels 32. Pumps (not shown) can be located under the bed 33 in the vicinity of the hydraulic tanks 34. Preferably, a variety of pumps are used, some of which have multiple functions. For example, actuating hydraulics for the tongs 24 and slips 22,23 might be powered by a pump which is also temporarily employed to raise the snubbing unit 11 on rig-up. Separate accumulators 35 are used to separate primary BOP operation from accumulators provided for other operations such as snubbing BOP.

In FIGS. 4A and 4B, a variety of auxiliary equipment (discussed below) is also mounted off of the axis A as shown, in the embodiments herein, as being on the driver's side of the truck, leaving one side of the truck equipment bed 33 open to accept lengths of tubulars 21 from the bed's open side 17. The forward spacing of the cab 31 in a cab-over arrangement can enable handling of lengths of tubulars 21 which extend from about the steering wheels 32 to a rear of the equipment bed 33. Similarly a half-cab or side cab can make one side available for opening up a greater length of the truck for handling tubulars.

Figure 15:
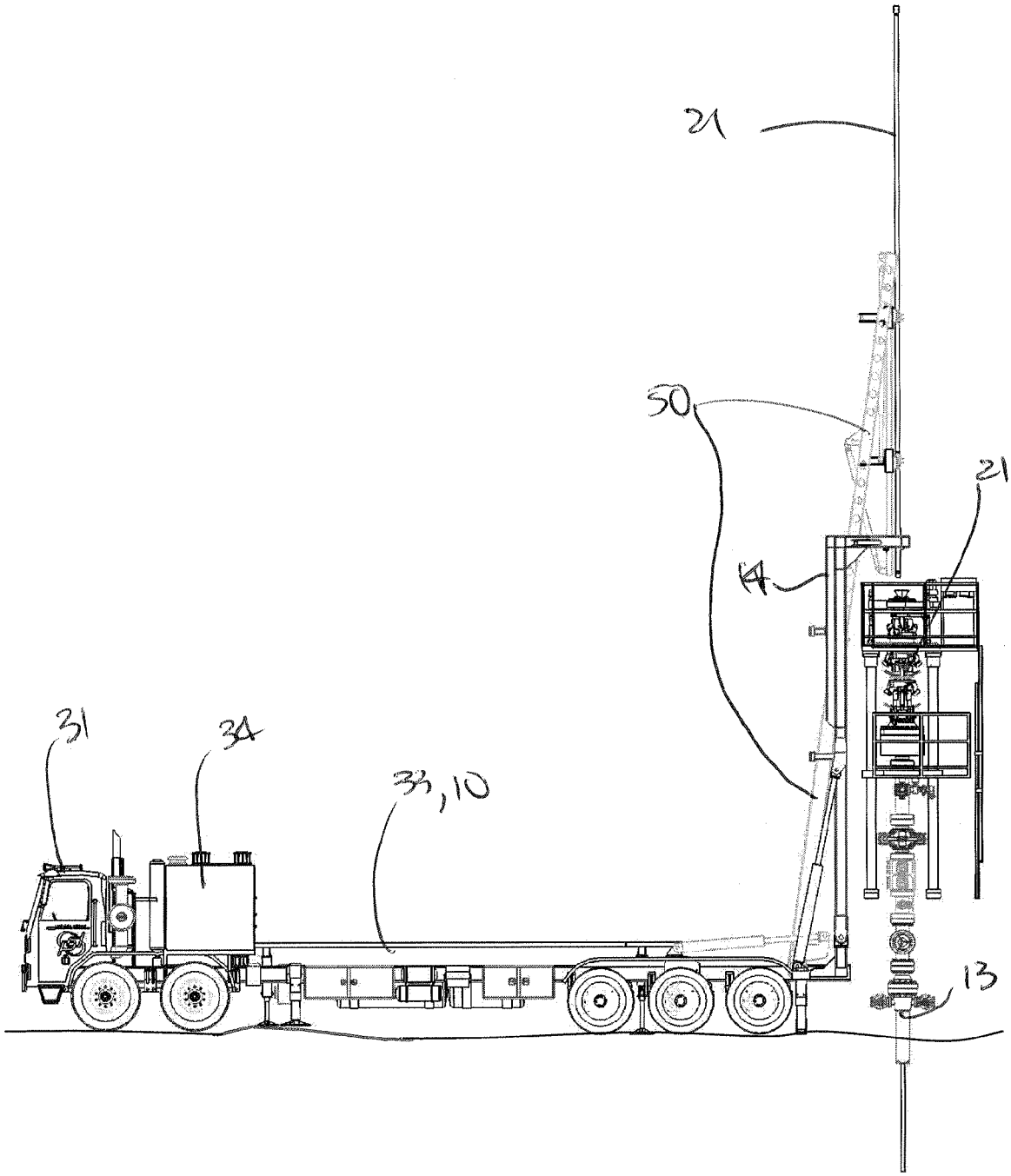
FIG. 15 is a side elevational view of FIG. 12 from the closed side—the ground being omitted to show the casing and tubing extending through the casing.
Figure 16:
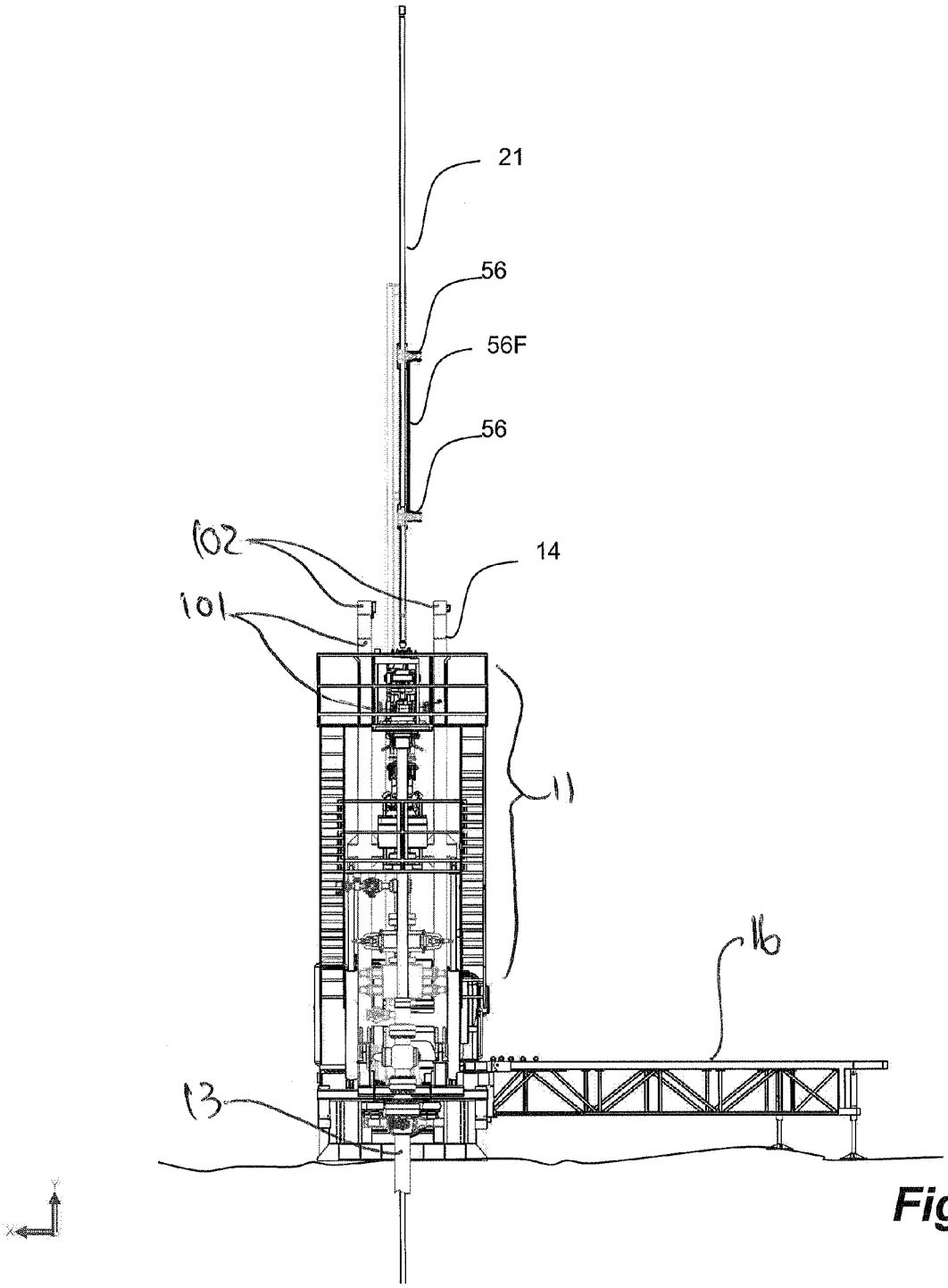
FIG. 16 is a rear view of FIG. 12.

Best shown in the views of FIGS. 1, 3 and 15, along the truck equipment bed 33 is a load leveling and stabilization system of hydraulic jacks 40 and pads for adjusting the snubbing unit 11 over the wellhead 13 and supporting the loads over the wellhead 13. At a rear end of the truck equipment bed 33 is a ground-engaging beam 41, actuated adjacent opposing ends by hydraulic jacks 40 to support the truck bed 33.

With reference to FIGS. 4A and 5, along the axis A of the equipment bed 33 is a pipe handler 20 rotatably operable between a racking, grabbing or platform position 20*g* substantially flush with the bed 33 and an elevated snubbing position 20*s* above the snubbing unit 11. The pipe handler 20 comprises a boom 50 pivoted from the truck equipment bed 33, more preferably at a first proximal end 51 at the rear of the equipment bed 33. Note that the snubbing unit 11 can require a length of tubular 21 to be raised well above the snubbing unit 11, a distance that is beyond the ability of a conventional pivoting boom to access. Accordingly, not only is the pipe handler 20 provided on the same platform 10 as the snubbing unit 11, but the pipe handler 20 itself has additional features adapted to the constraints of the length of the platform 10 while also providing the functionality required.

Figure 24:
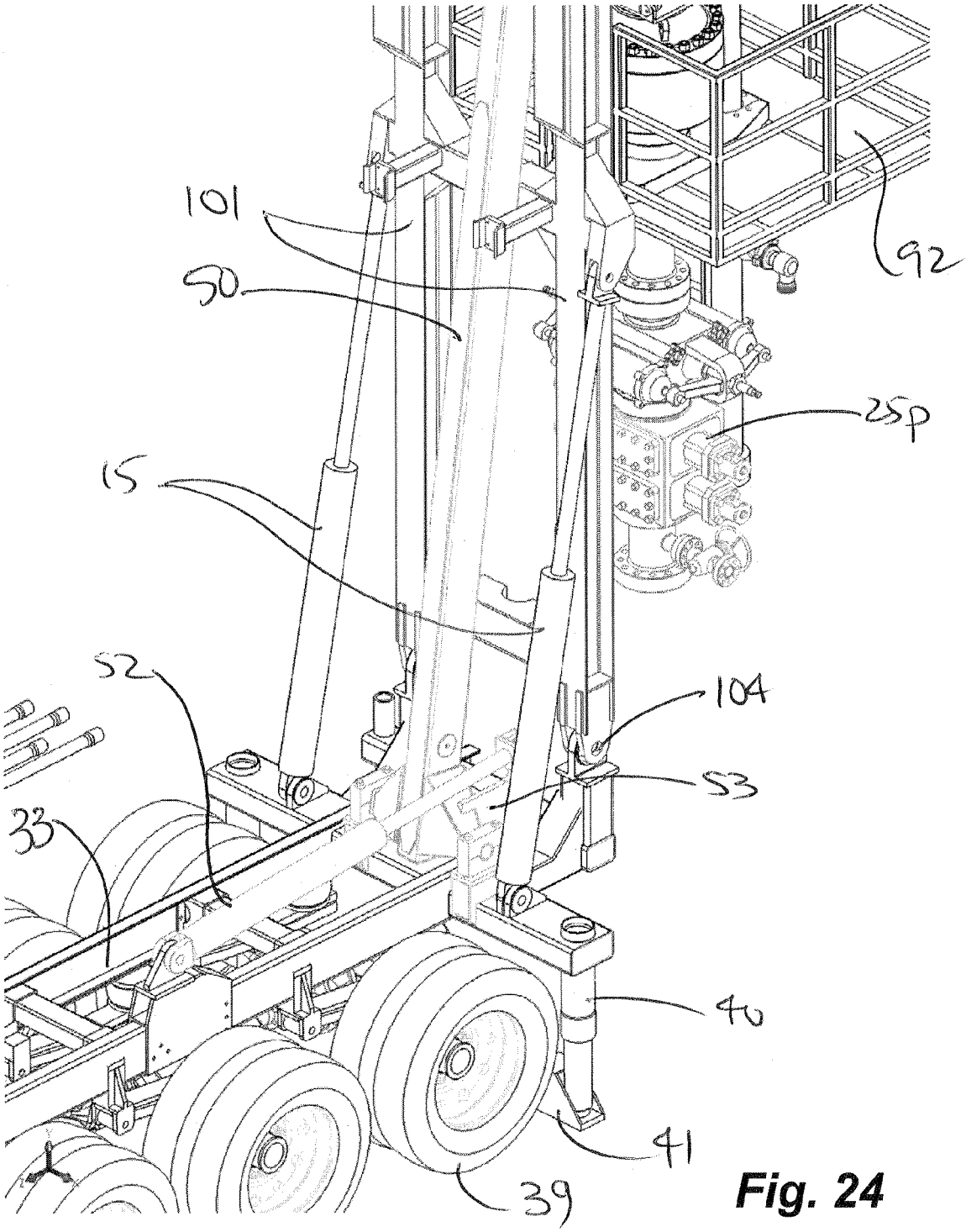
FIG. 24 is a partial close up perspective view illustrating the actuators for the L-frame.
Figure 25:
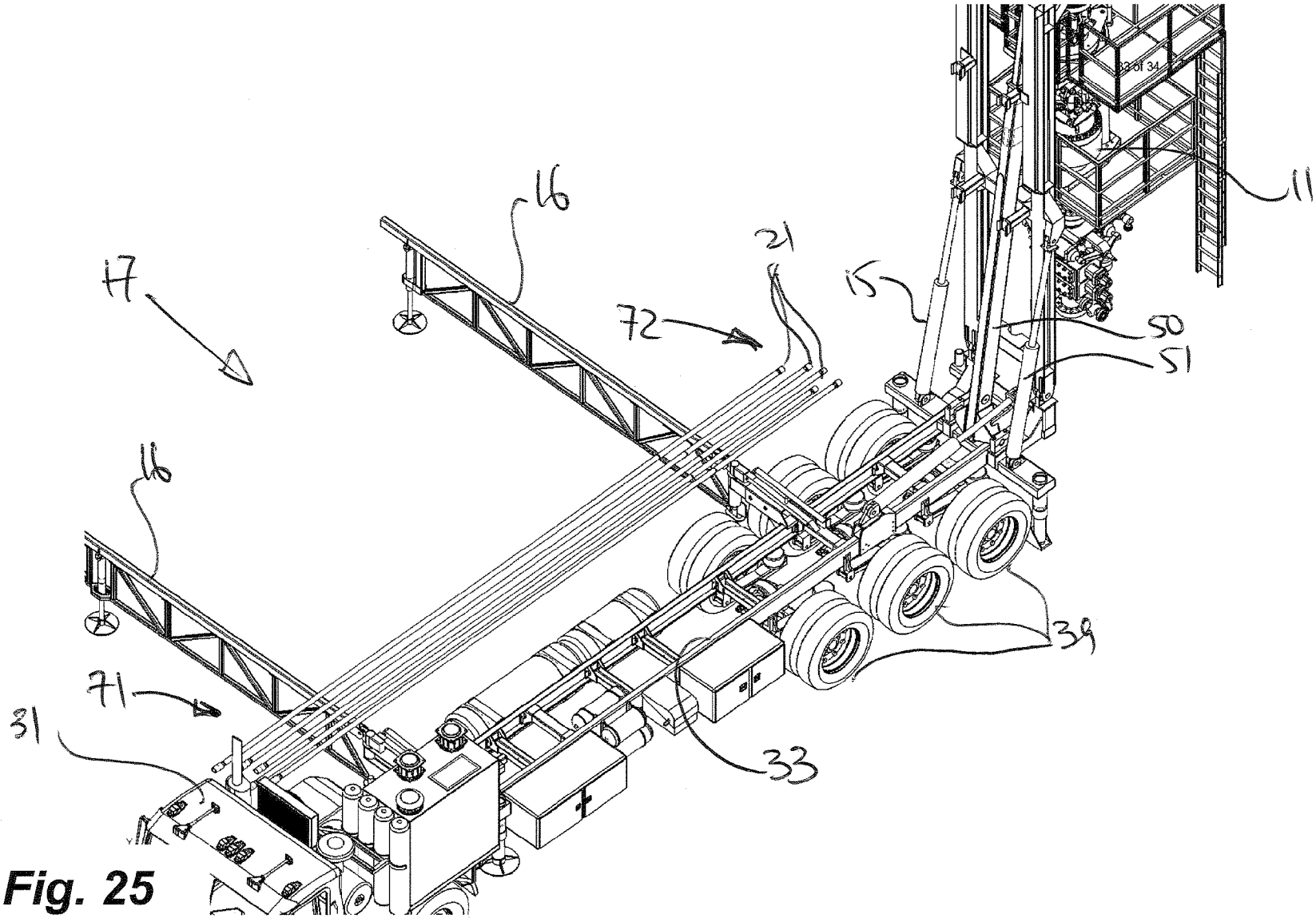
FIG. 25 is a partial perspective view of the truck bed and L-frame with the rear pipe rack arm extended and the removable sections re-installed, the pipe rack arm supporting tubulars and outrigger stands supporting the racks.
Figure 26:
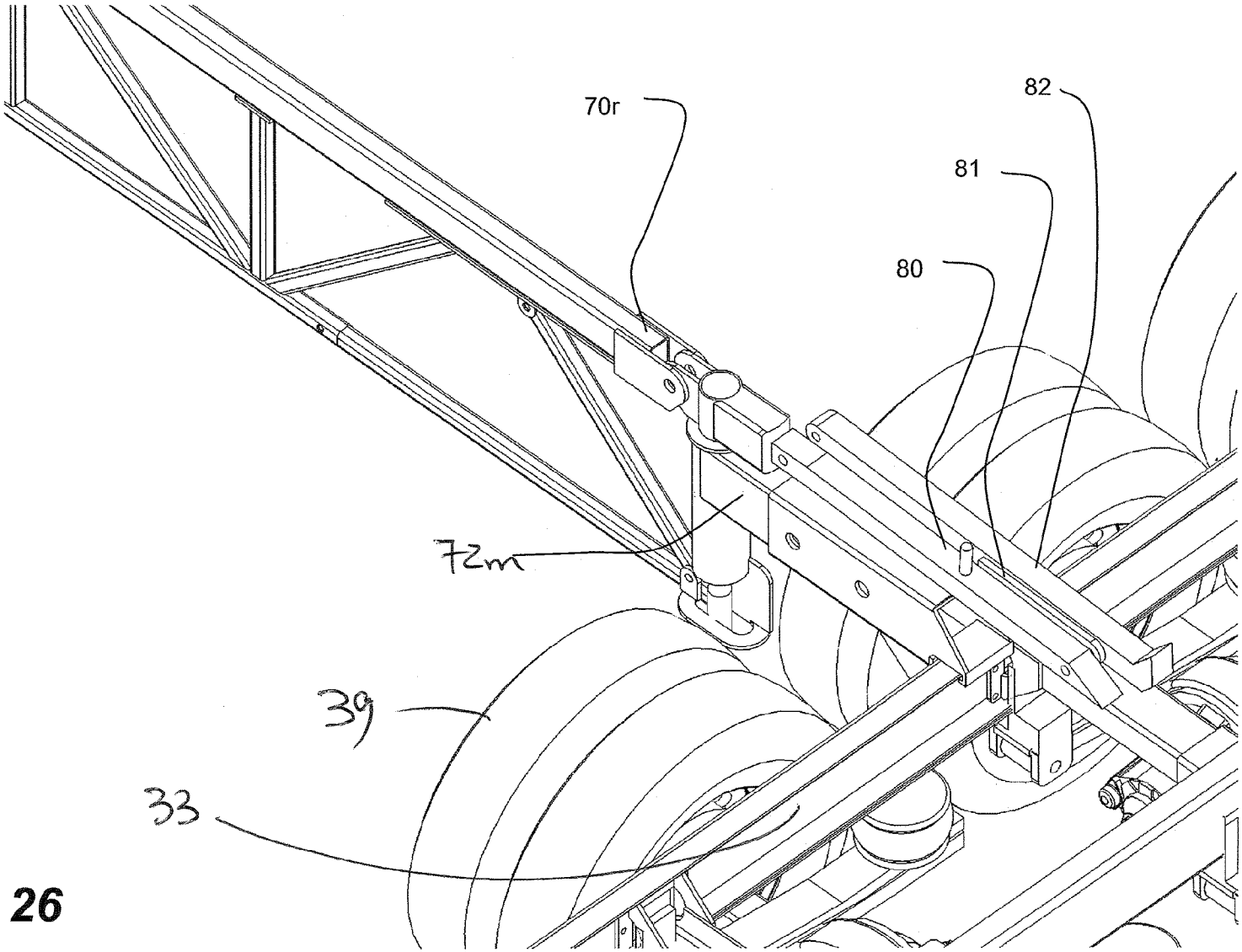
FIG. 26 is a close up of FIG. 25 illustrating the telescoping rear rack arm pivot and installed removable sections.
Figure 27:
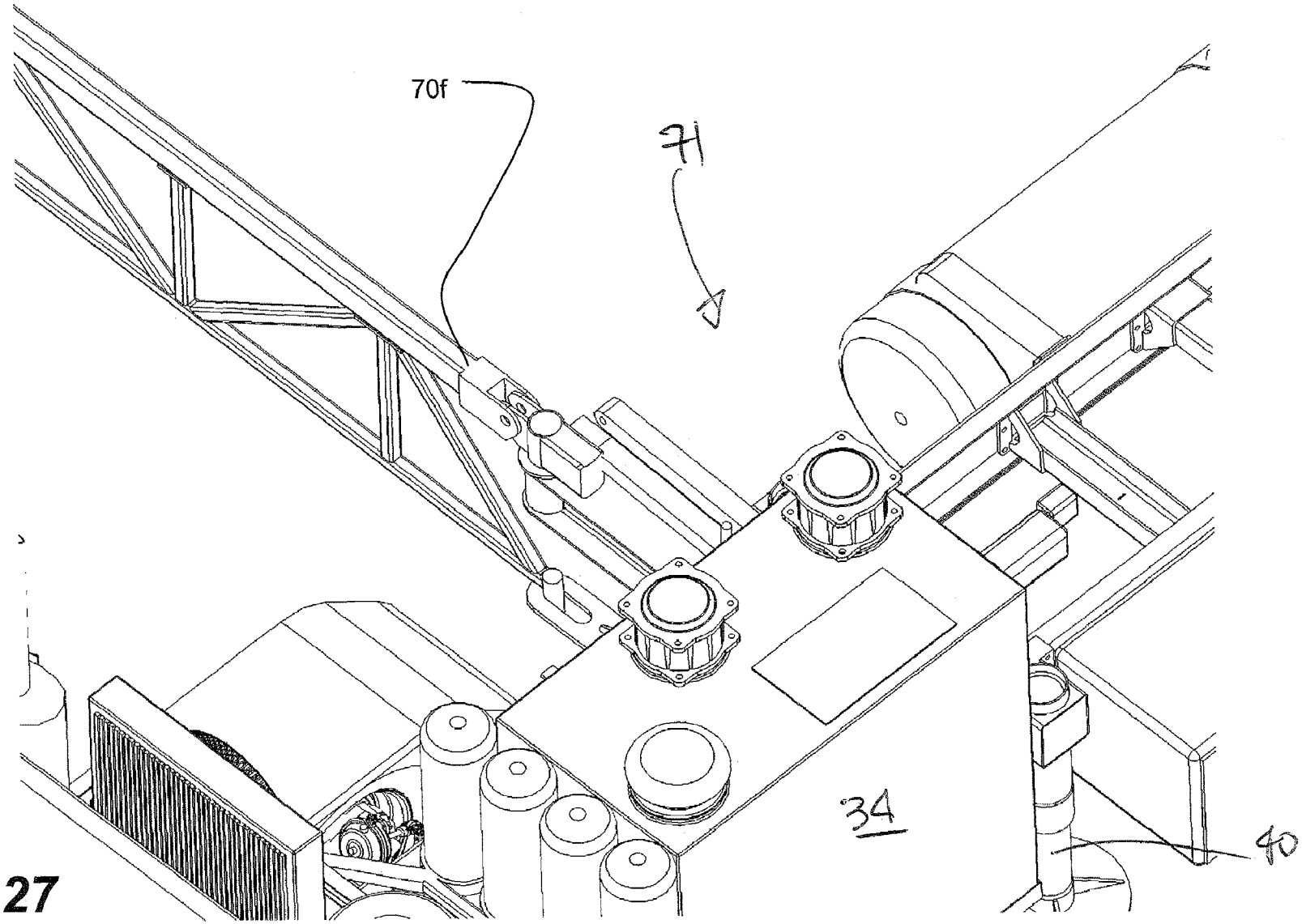
FIG. 27 is a close up of pivoting connection of the front pipe rack arm to the open side.

A hydraulic boom actuator 52, and shown in more detail of FIG. 24, is situated between a bracket 53 extending from the boom 50 and the equipment bed 33 for manipulating the boom 50 between the platform and snubbing positions 20*g*, 20*s*. The boom 50 is telescoping for sweeping tubulars 21 from the equipment bed 33 of a fixed position, compact length while pivoting upwards and telescoping for reaching upwards to greater heights in the snubbing position.

Figure 23A:
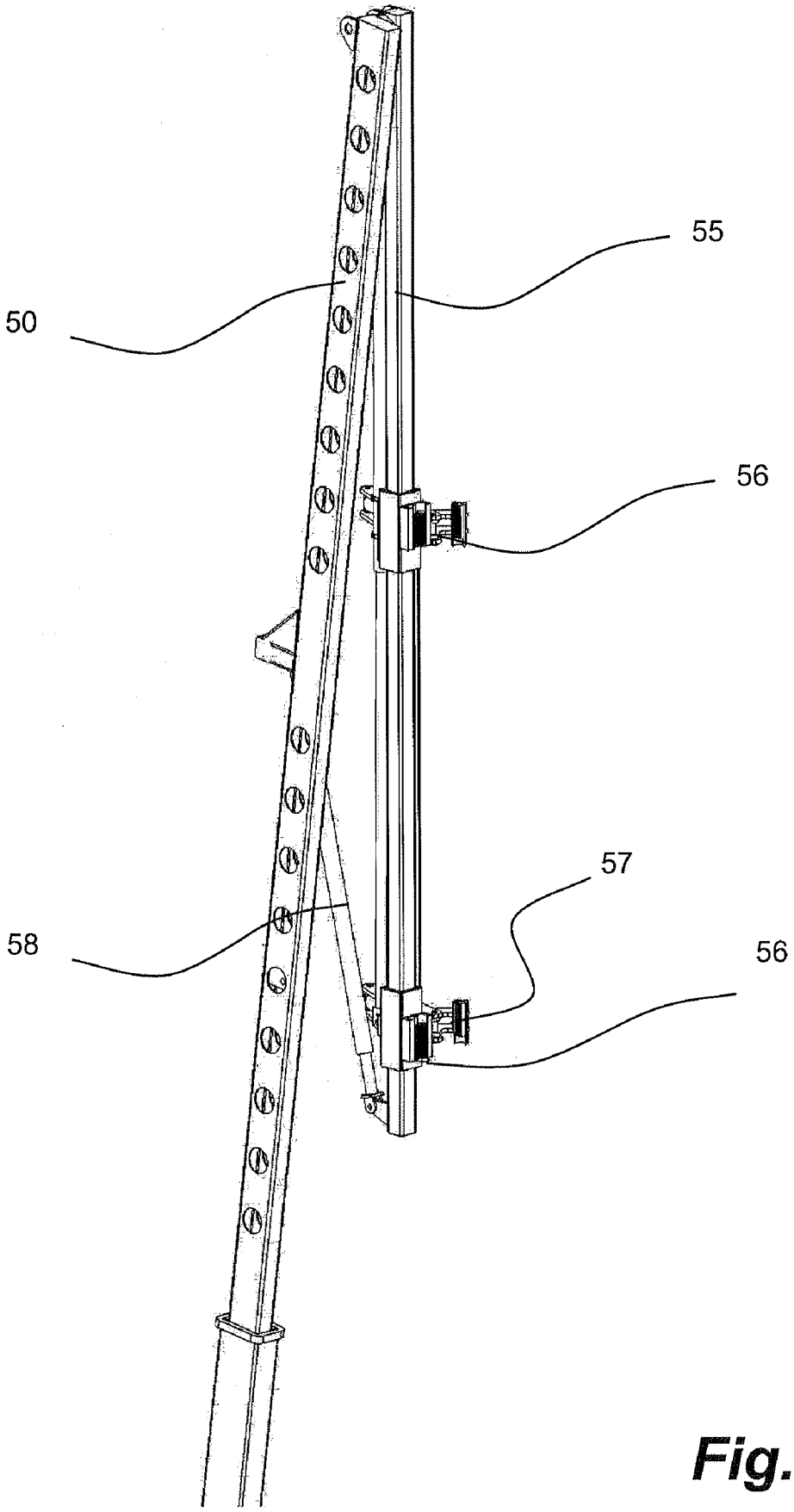
FIG. 23A is a perspective view of an embodiment of a pipe handler having a boom and pipe carriage with spaced tubular gripping and guide clamps (opened)
Figure 23B:
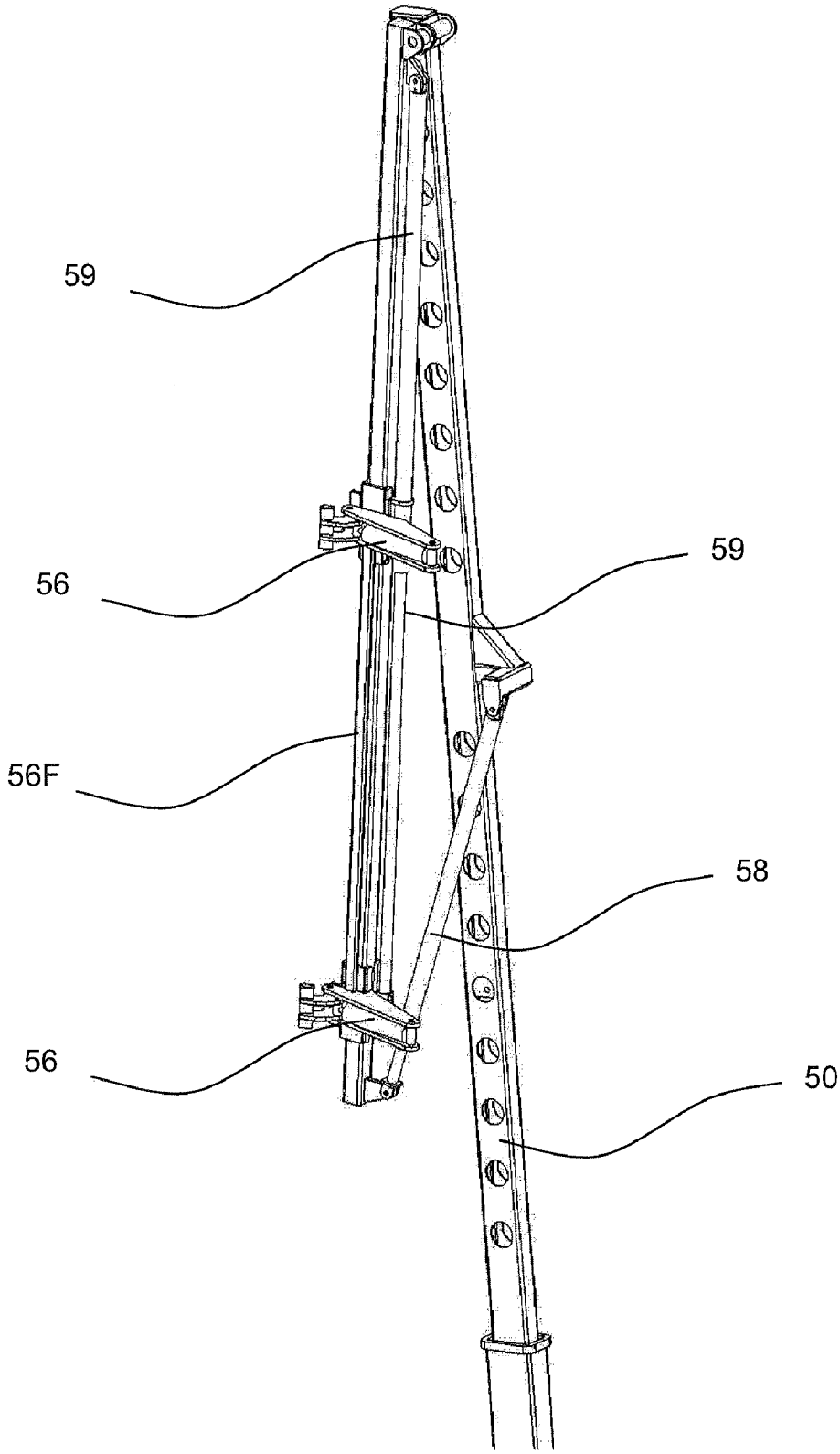
FIG. 23B is a perspective view of an embodiment of FIG. 23A from another viewpoint.

In one form of the pipe handler 20, and with reference also to FIGS. 19,20 and FIGS. 23A, 23B, a pipe guide or carriage 55 is pivotally mounted to a distal end 53 of the boom 50. Spaced along the carriage 55 are a pair of pipe clamps 56, at least one of which is fitted with gripping teeth 57 so as to be operable to grip and release tubulars 21 (FIGS. 19,20) and at least one other clamp 56 to guide the tubular. A carriage tilt actuator 58 is operably mounted between the carriage 55 and the boom 50 for varying the angular position of the carriage 55 relative to the boom 50. As stated, the boom 50 is extendable for raising the tubular 21 higher above the snubbing unit 11 than the pickup from the equipment bed 33 would otherwise permit. Further, as shown in FIGS. 23A and 23B, the pipe clamps 56 can be supported on a frame 56F slidable along the carriage 55. The clamp frame 56F can also be axially manipulated with a stab actuator 59 to further extend the position of the tubulars 21. Sensors provide feedback of the position of the carriage 55 relative to the equipment bed 33 and the snubbing unit 11. For example, sensors can be utilized for measuring axial and angular position of the boom 50 relative to the equipment bed 33 and the position of the carriage 55 relative to the boom 50.

As shown in FIG. 5, the pipe handler 20 is pivotally actuated and is automated. Using electrical over hydraulic, the pipe handler 20 can be manually or automatically guided to move tubulars 21 between the equipment bed 33 and the snubbing unit 11. Preferably, the pipe handler 20 is first manually guided and the movement is learned by a control system. A control system having a programmable logic controller (PLC) is implemented to automate pipe handling. Thereafter, the pipe handler 20 movement can be automatic based upon the equipment bed 33 and the snubbing unit 11 position being known and being immovable once connected to the wellhead 13.

Figure 19:
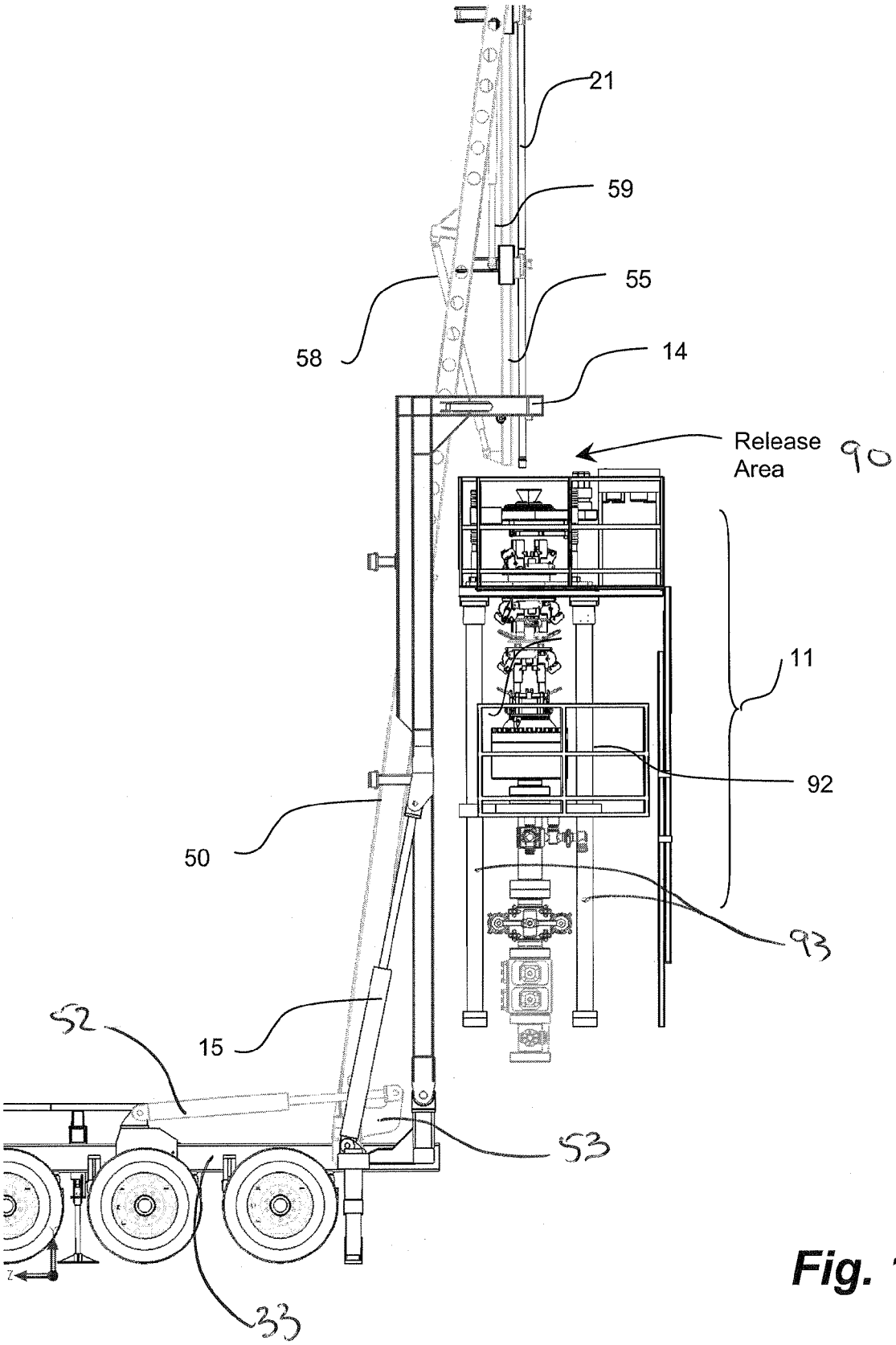
FIG. 19 is a side elevational view of the rear of the system for illustrating the actuators for the L-frame and pipe handler (wellhead omitted for clarity)
Figure 20:
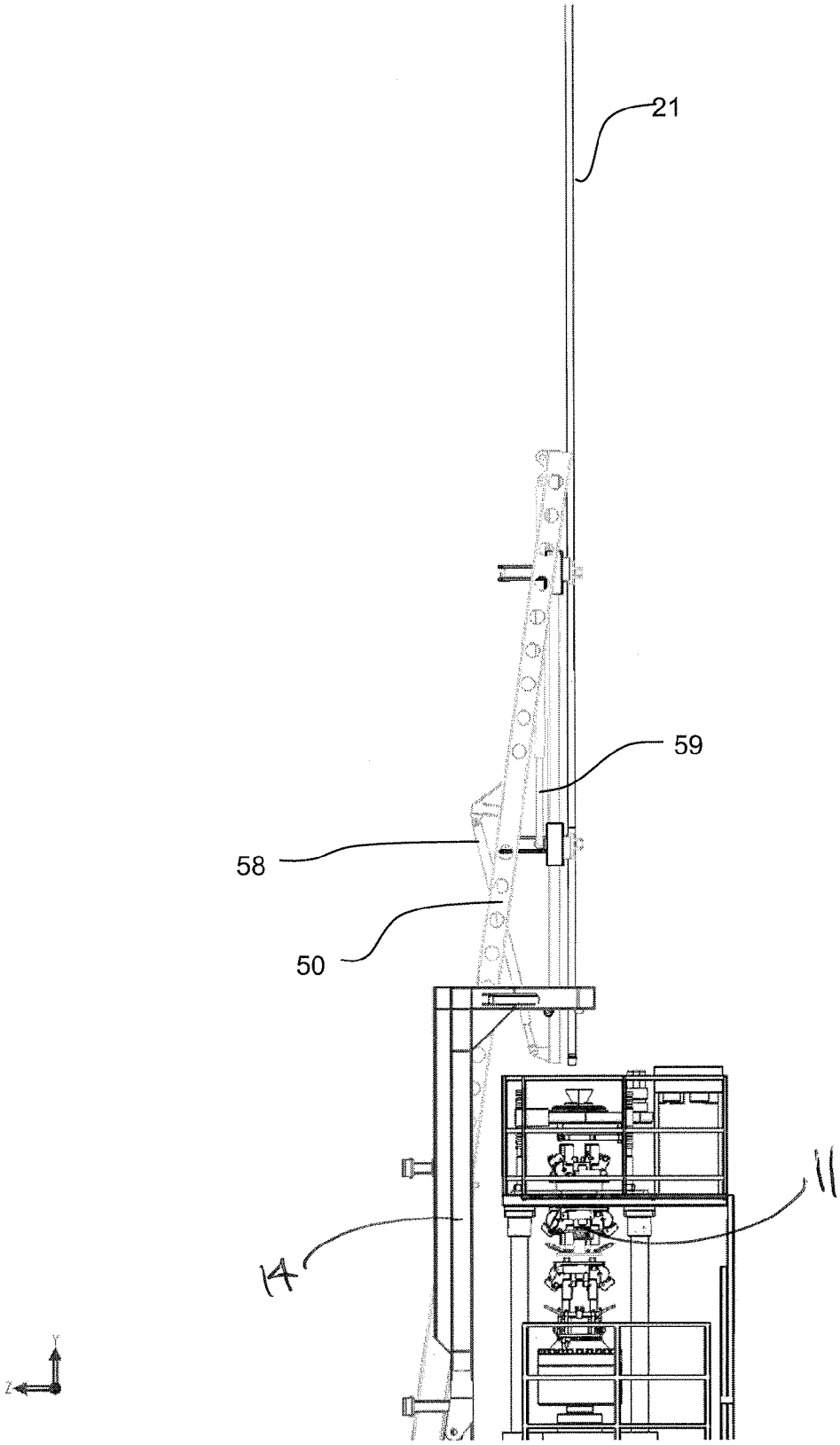
FIG. 20 is a partial side elevational view of the pipe handler shown gripping a tubular above the snubbing unit, about to be stabbed therein.

FIGS. 5, 19 and 20 show the relationship between a lower stab end 60 of the tubulars 21 and the snubbing unit 11. The position of the stab end 60 of the tubulars 21 can be known, or more preferably, the tubulars 21 can be lowered to engage the snubbing unit 11, preferably an accepting cone 132 and feedback confirms the location of the stab end 60 of the tubing.

Further, in another embodiment (not shown) should the tubular 21 be slightly off-centre, the carriage 55 of the pipe handler 20 can contain biased mounting for enabling a certain pre-loaded displacement to be stored therein so that, once aligned, such as when the tongs 24 are engaged, the pre-load can drive the tubular 21 into engagement with a collar end 61 of the previous tubular 21 in the snubbing unit 11.

It is expected that an operator would rig up, nipple up and then train the pipe handler 20 with tubulars 21 for each site, thereafter being automated. Automated tongs 24 preferably complete the automation to make up joints of tubulars 21.

Pipe Racks

Figure 11A:
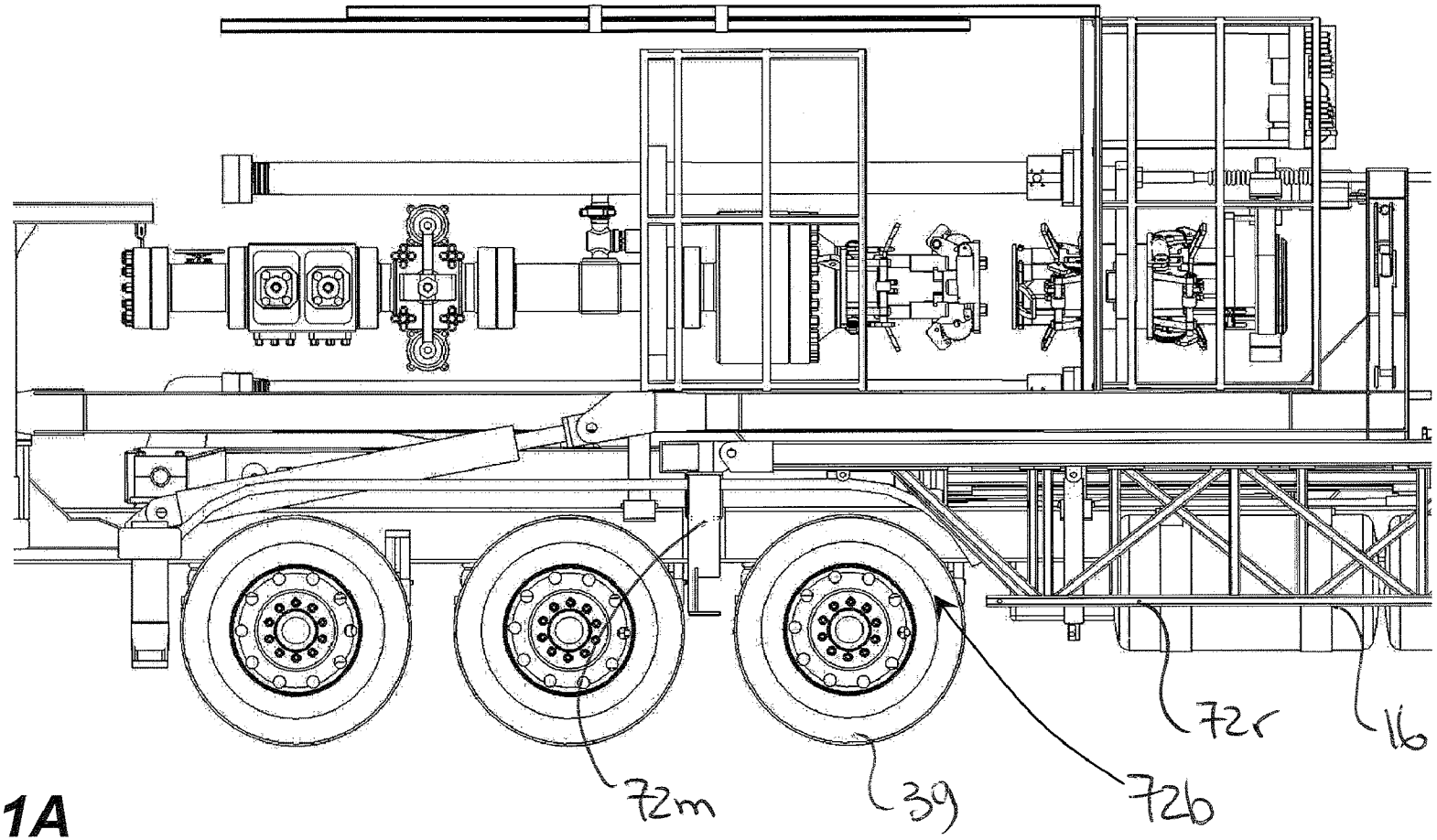
FIG. 11A is a partial side view illustrating the snubbing unit over the tridem drive from the open side and illustrating the rear (second) pivoted pipe rack arm and removable truss components shown removed for clearing the wheels.
Figure 11B:
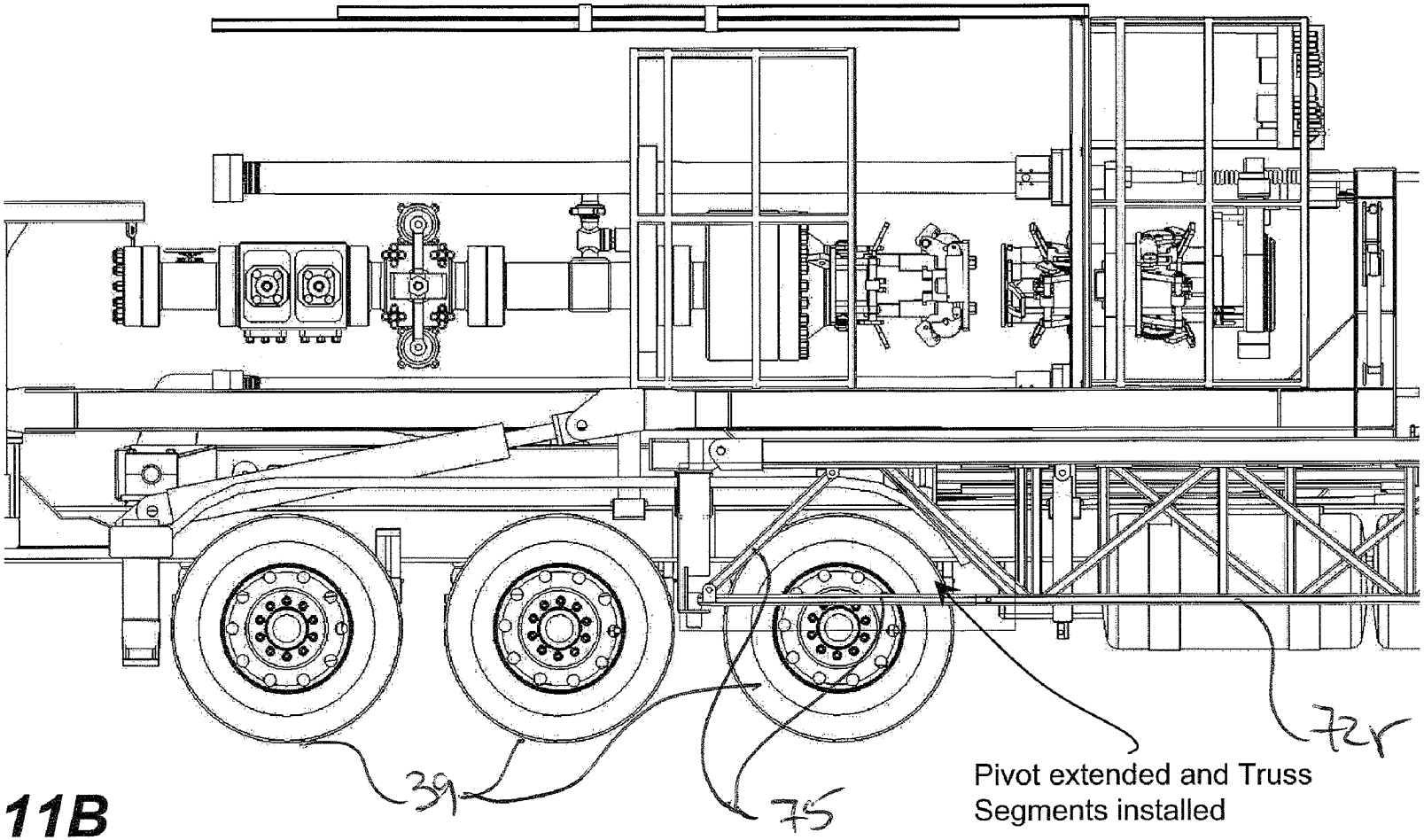
FIG. 11B is a partial side view of FIG. 11A with the rear (second) pipe rack arm pivot extended for clearing the wheels and the removable truss components installed.
Figure 12:
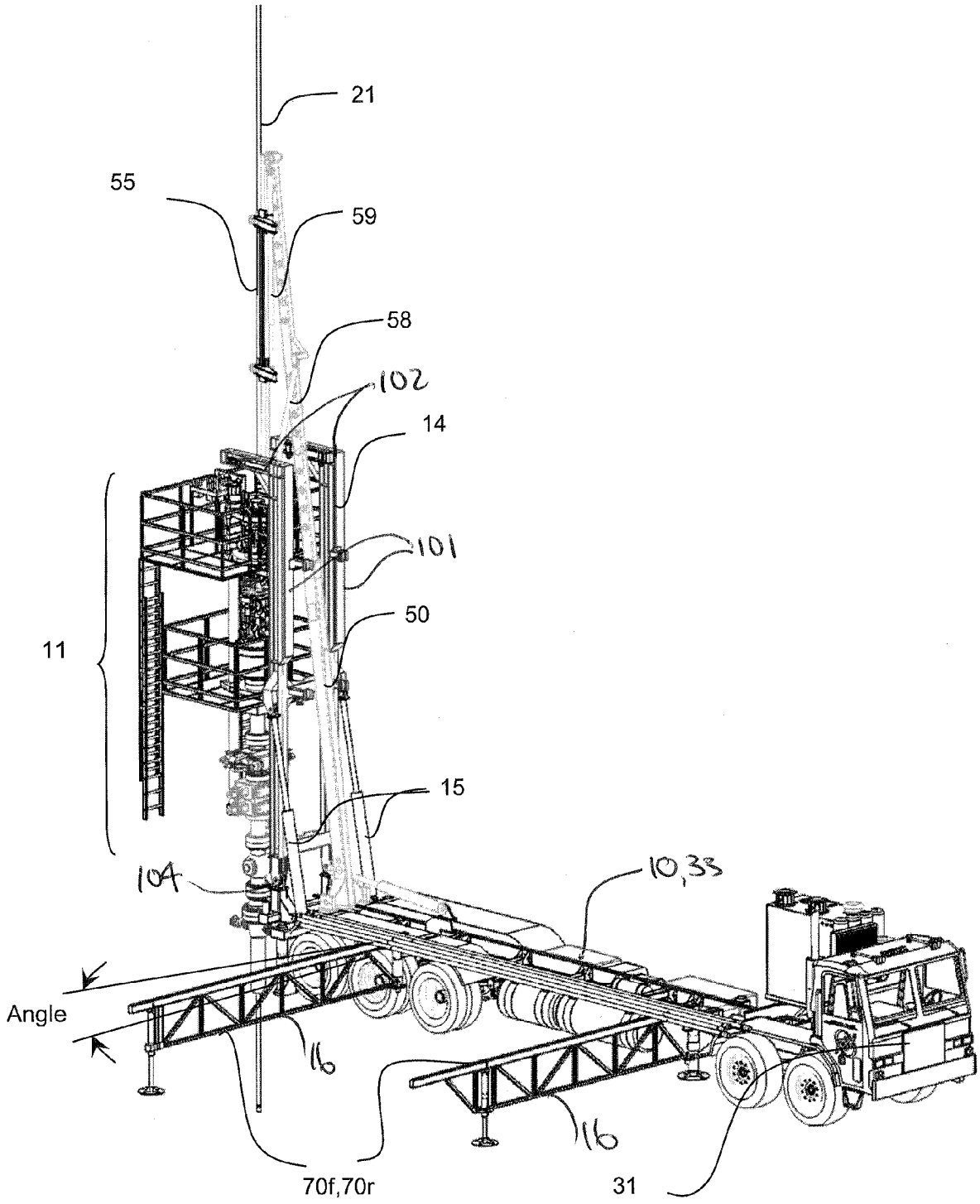
FIG. 12 is a perspective birds-eye view of the mobile snubbing system from the open side of the bed with the pipe rack arms extended and the pipe handler manipulating a tubular over the snubbing unit.
Figure 13:
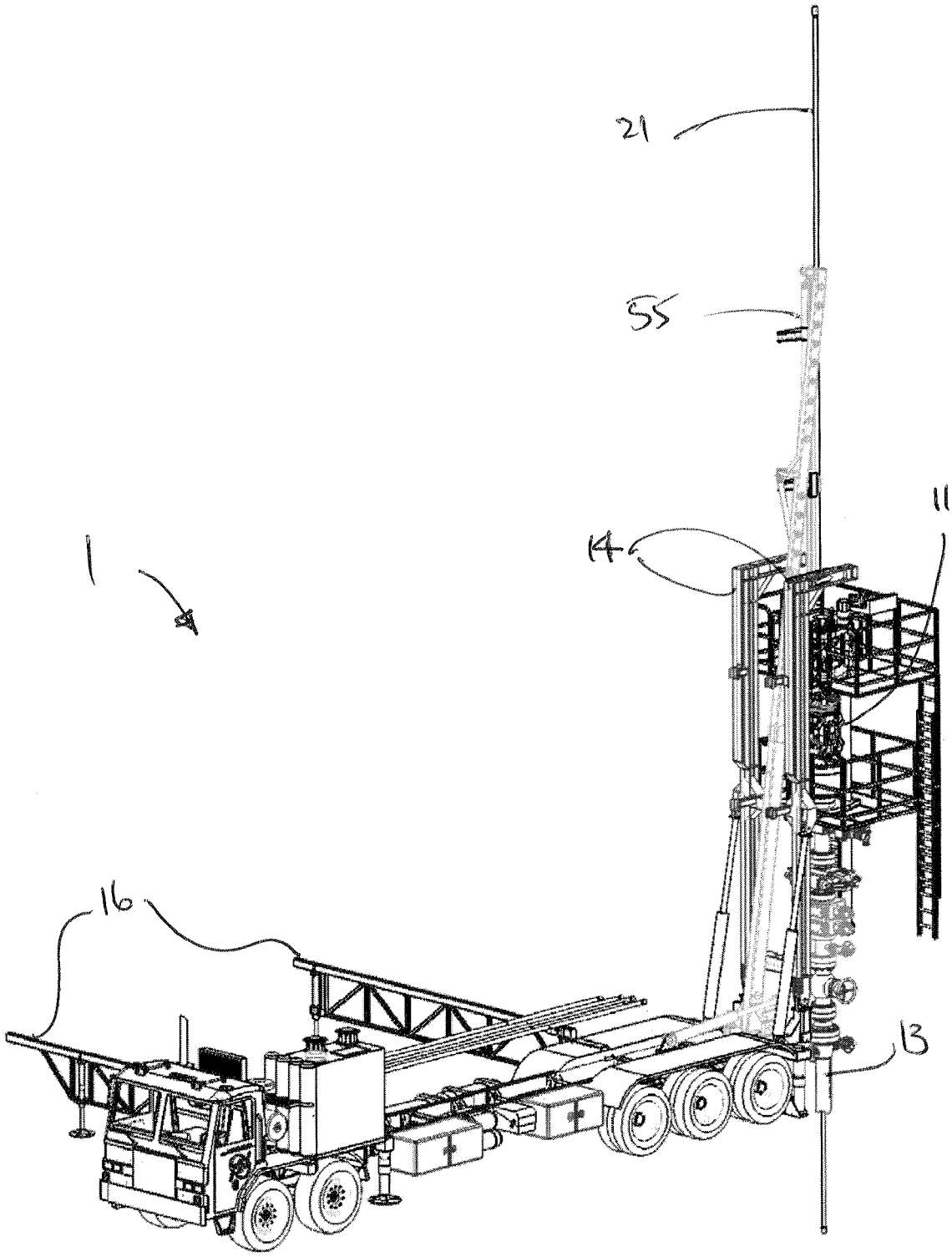
FIG. 13 is a perspective birds-eye view of FIG. 12 from the closed side.
Figure 14:
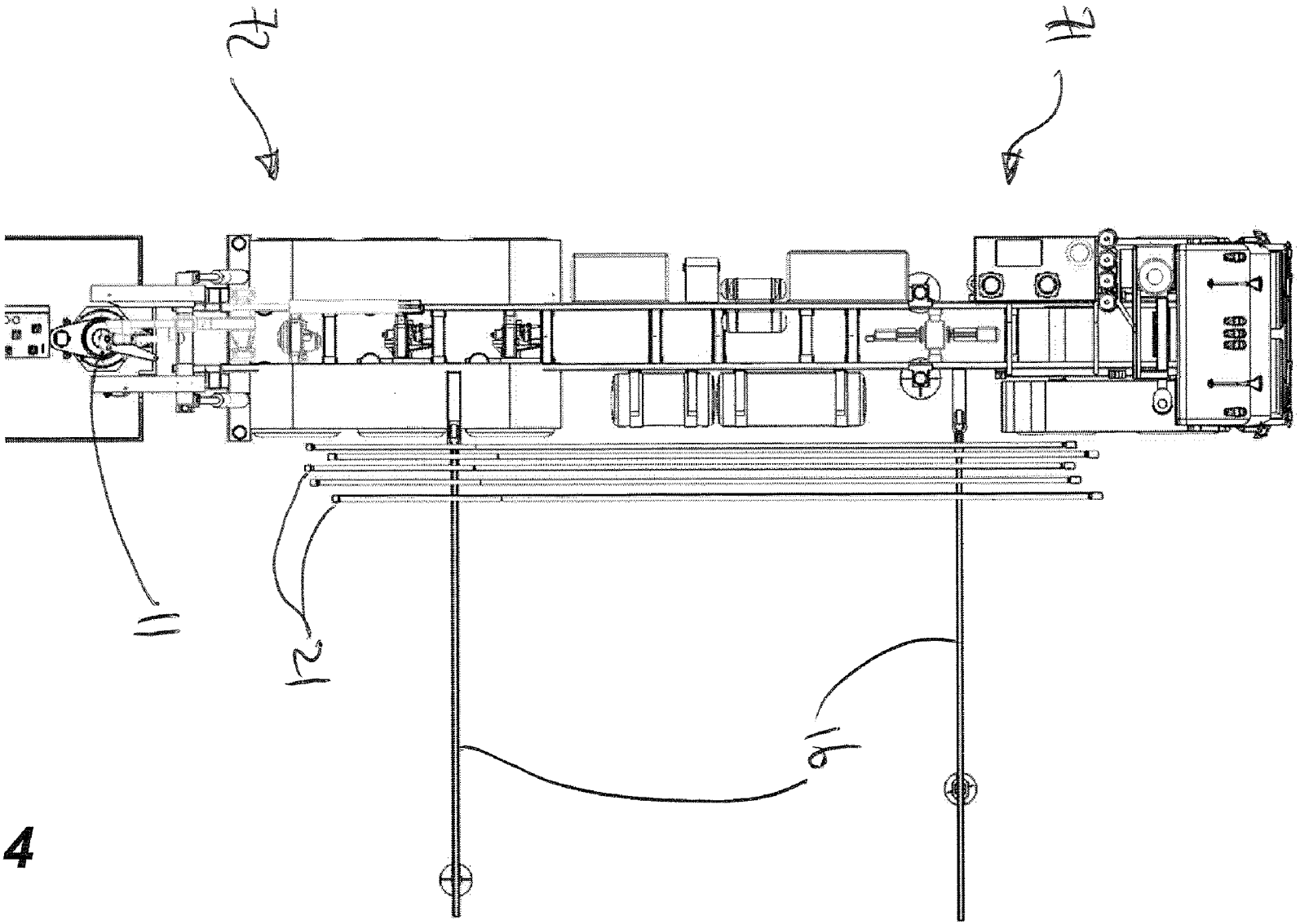
FIG. 14 is a plan view of FIG. 12.

With reference to FIGS. 4A, 4B, 7 to 9, 11A, 11B and 12 the truck equipment bed 33 further incorporates the pipe racks 16 comprising pipe rack arms 70. As shown in FIGS. 4A, 4B and 12, a pair of pipe rack arms 70 are pivotally mounted to the open side 17 of the bed 33: a first pipe rack arm 70*f* mounted at 71*m* adjacent a front 71 of the equipment bed 33, and a second pipe rack arm 70*r* mounted 72*m* adjacent a rear end 72 of the bed 33. Each pipe rack arm 70*f*,70*r* is a truss frame which is gate-swing mounted to the bed 33. For roading, each rack arm 70*f*,70*r* is swung parallel with the equipment bed axis A and secured to the equipment bed 33. When on site and rigging up, the pipe rack arms 70*f*,70*r* are swung out perpendicular to the equipment bed 33 and parallel to each other. Hydraulic stands or actuators 73 are provided adjacent outboard ends 74*f*,74*r* for supporting the arms 70*f*,70*r* and adjusting the angle of the pipe racks 16 relative to the equipment bed 33. The arms 70*f*,70*r* are spaced apart to support the tubulars 21 at support points to minimize sag.

As shown in FIGS. 21A to 21D, 22, 26 and 27, fit to the equipment bed 12 is an automated pipe magazine 80, indexer 81 and a kicker 82 adjacent the pivoting connection or mounting 71*m*,72*m* of each front and rear pipe rack arm 70*f*,70*r*. The indexer 81 and kicker 82 manage tubulars 21 to and from the pipe racks 16 and the pipe handler carriage 55.

Figure 21A:
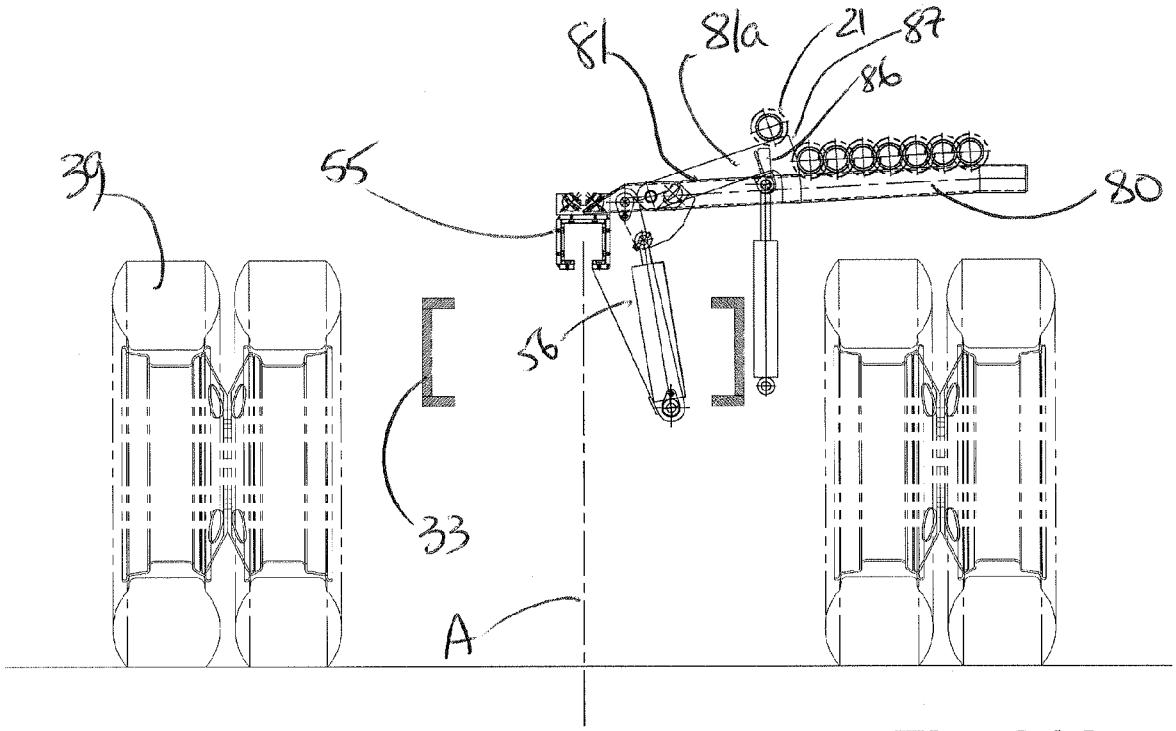
FIG. 21A is a cross-sectional rear view illustrating the pipe rack arms.
Figure 21B:
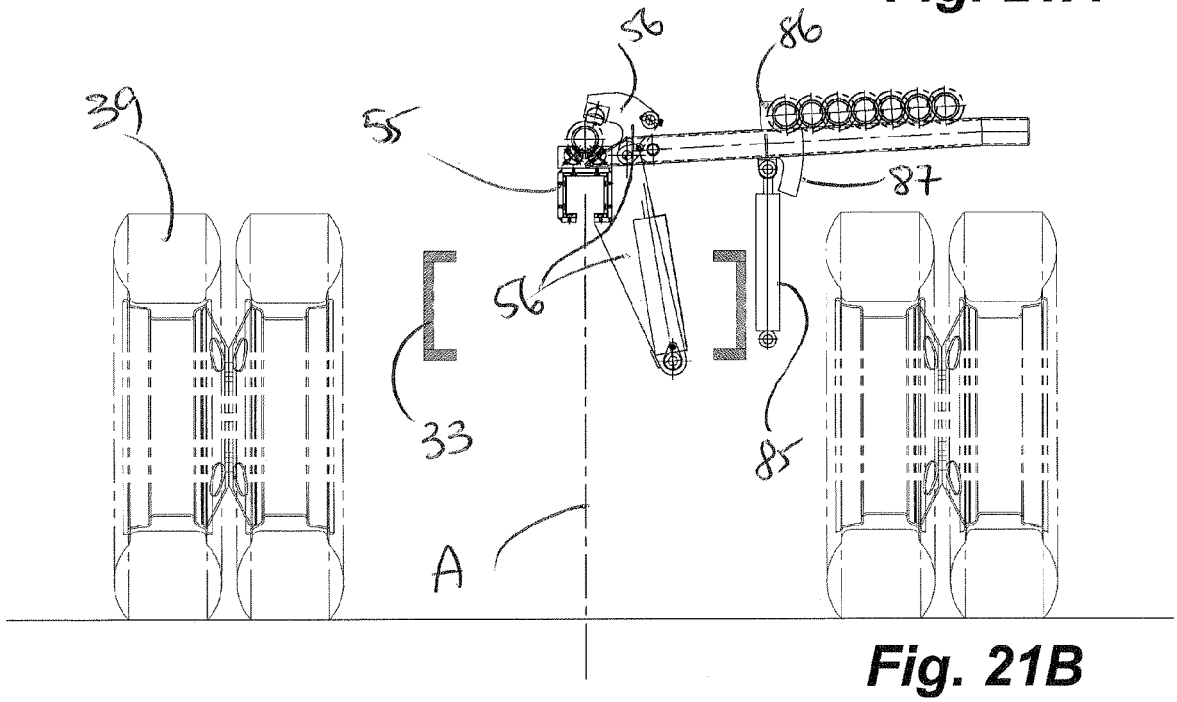
FIG. 21B is a cross-sectional partial rear view illustrating the indexer and the pipe handler clamp closed.

In this embodiment, the magazine 80 can hold about seven tubulars 21,21 . . . . Shown in FIG. 22, the magazine 80 can receive lengths of tubulars 21 from the pipe racks 16, and the indexer 81 presents them one at a time to the pipe handler 20. In FIG. 21A, the magazine 80 is inclined for rolling tubulars 21 to the indexer 81. For loading tubulars 21, the magazine 80 holds the plurality of tubulars resting against a stop 86. In FIG. 21B, the indexer comprises a lever 81*a* which is actuated by an indexing actuator 85 to lift one tubular 21 over the stop 86 while a trailing cam 87 holds back the remaining tubulars. The lifted tubular 21 rolls down the lever 81*a* to the pipe handler 20. Once in the pipe handler 20, the pipe handler clamps 56 close.

Figure 21C:
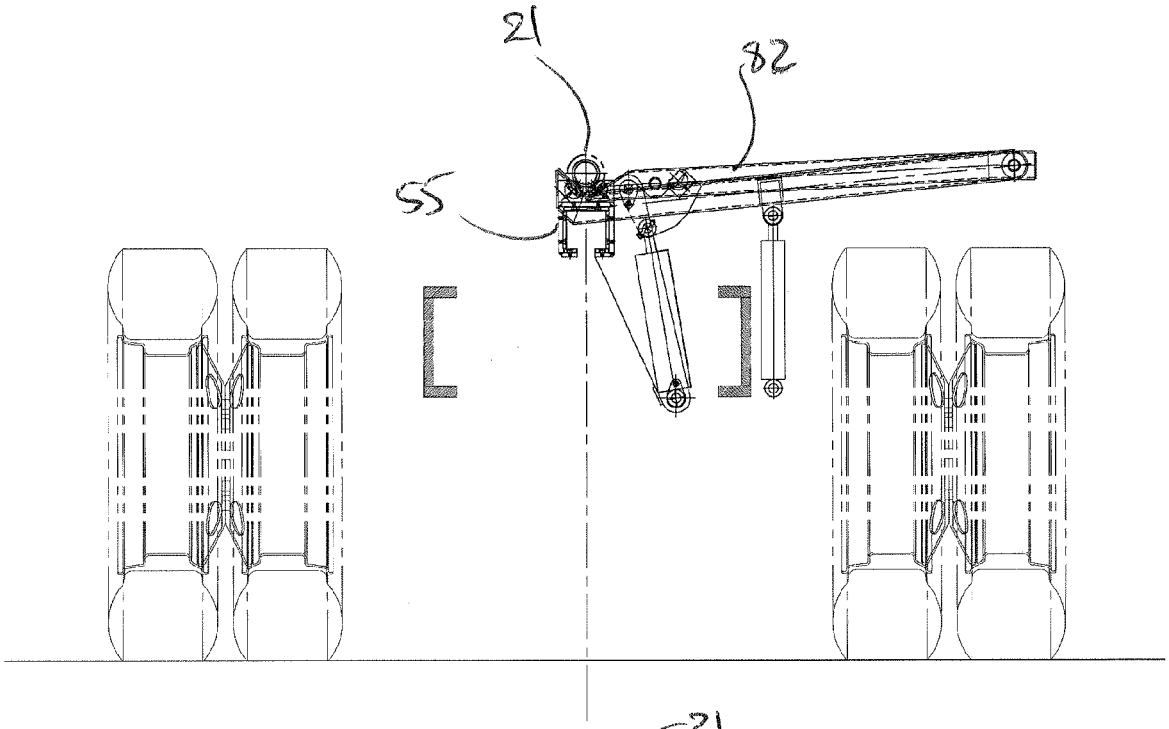
FIG. 21C is a cross-sectional partial rear view illustrating the indexer lever selecting a tubular and with the pipe handler clamp open to receive the tubular of FIG. 12B.
Figure 21D:
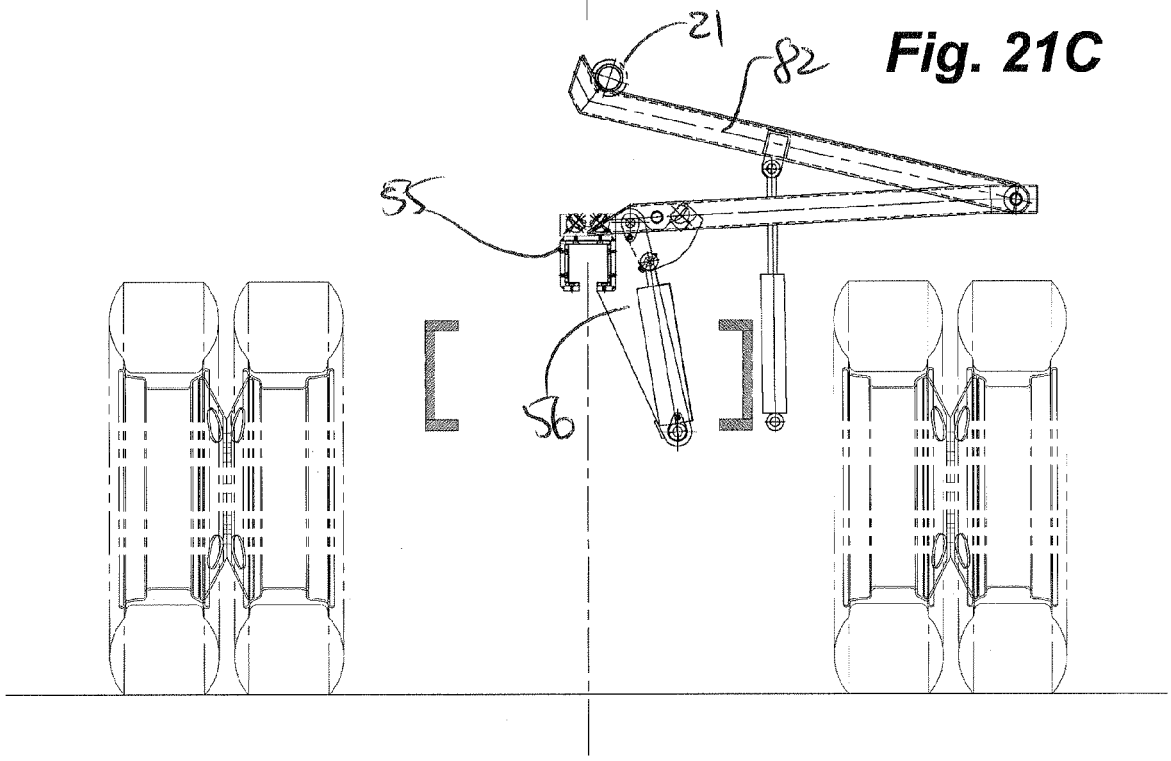
FIG. 21D is a cross-sectional partial rear view illustrating the kicker removing a tubular from the pipe handler.

As shown in FIGS. 21C and 21D, for off-loading tubulars 21, the kicker 82 can expel a length of tubular from the pipe handler 20, the tubular 21 rolling down the kicker 82 to the pipe racks 16.

As shown, the rear pipe rack arm 70*r* is pivotally mounted at about the tridem rear drive wheels 39. As shown in FIG. 11A, for enabling maximum road width of the wheel track and truck bed 33, while still accommodating the pipe racks 16 when stowed, this rear pipe rack arm 70*r* preferably includes a breakout portion 72*b* of the truss at the mounting end 72*m* to avoid interference with the wheels 39. For shipping, once the truss section or sections are removed, the remaining portion of the rack arm 70*r* is hydraulically drawn laterally inward and clearing over the tires for transport mode. With reference to FIG. 11B, on rig up, the rack arm 70*r* is hydraulically forced out laterally beyond the tires and allowing the truss section or sections 75 to be reinserted and fastened into the truss when swung out for operation.

Safety of the Snubbing Crew

Figure 17:
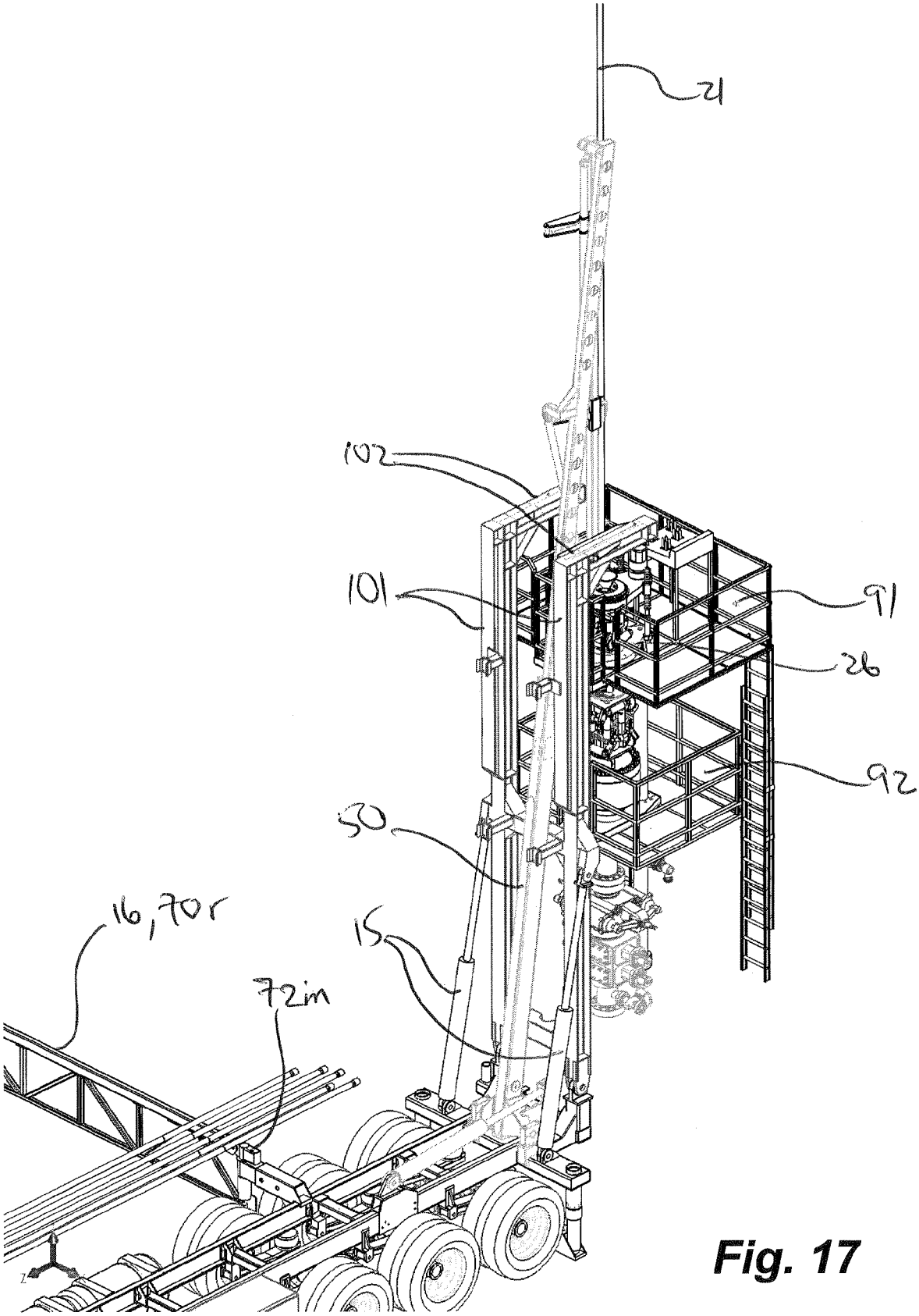
FIG. 17 is a perspective view illustrating the L-frame and actuators and the pipe handler with the pipe carriage and a tubular stabbed above and into the traveling slips.

With reference to FIGS. 3, and 12 through 20, automation of the pipe handler 20 and automation of the tongs 24 avoids the conventional practice and need for personnel to be above the "release point" 90, being the point at which wellbore fluids or tubing could exit the well in an upset. As best shown in FIGS. 17 and 19, a top platform 91 can be provided at the traveling slips 23 for maintenance purposes but there would be no need for personnel to be present during snubbing. In an alternate version, a single platform 92 can be employed which can travel vertically up or down providing a safe working platform for any area along the snubbing unit 11. This would allow the operators to position themselves below the release point when performing snubbing operations. One approach is to use a rack and pinion drive (not shown) between the platform 92 and the snubbing unit 11, such as along the hydraulic actuators 93,93. In the current embodiment, controls 94 for various functions are shown on the top platform 91. As stated, the controls would more preferably be located on the lower platform 92 as there is no longer a need for personnel to be located at the area or the traveling slips 23. Further, at the back of the truck equipment bed 12 is a series of duplicate controls and other controls (not shown) for raising the L-frame 14, operating leveling jacks or stands, pipe rack stands and the rear pipe rack telescopic actuator.

Snubbing Unit L-Frame

As shown in FIGS. 3 and 12 through 19, the snubbing unit 80 is supported by the frame 14. In this embodiment, the frame is an L-frame comprising a pair of parallel, spaced, upside down L-shaped members 100 having legs or first members 101 and arms or second cantilever members 102.

In the shipping position, the legs 101 of the L-shaped members 100 form a substantially horizontal carriage 103. The snubbing unit 11 is supported on one or more supports fit with V-rollers so as to permit the snubbing unit 11 to roll along angle-iron tracks extending along the legs 101. Removable saddle supports (not shown) can be fit to the snubbing unit 11 at flanges, the annular BOP or other locations such as the platform 91, 92 structure. Once raised, the supports are no longer engaged with the L-frame 14.

The L-frame 14 is pivotally mounted at the tip or proximal end 104 of the leg 101 of each L-shaped member 100,100 at the rear 72 of the truck equipment bed 33. The L-frame 14 is rotatable to an elevated position with the snubbing unit 11 upright and the arms 102 extending substantially horizontally.

Figure 18A:
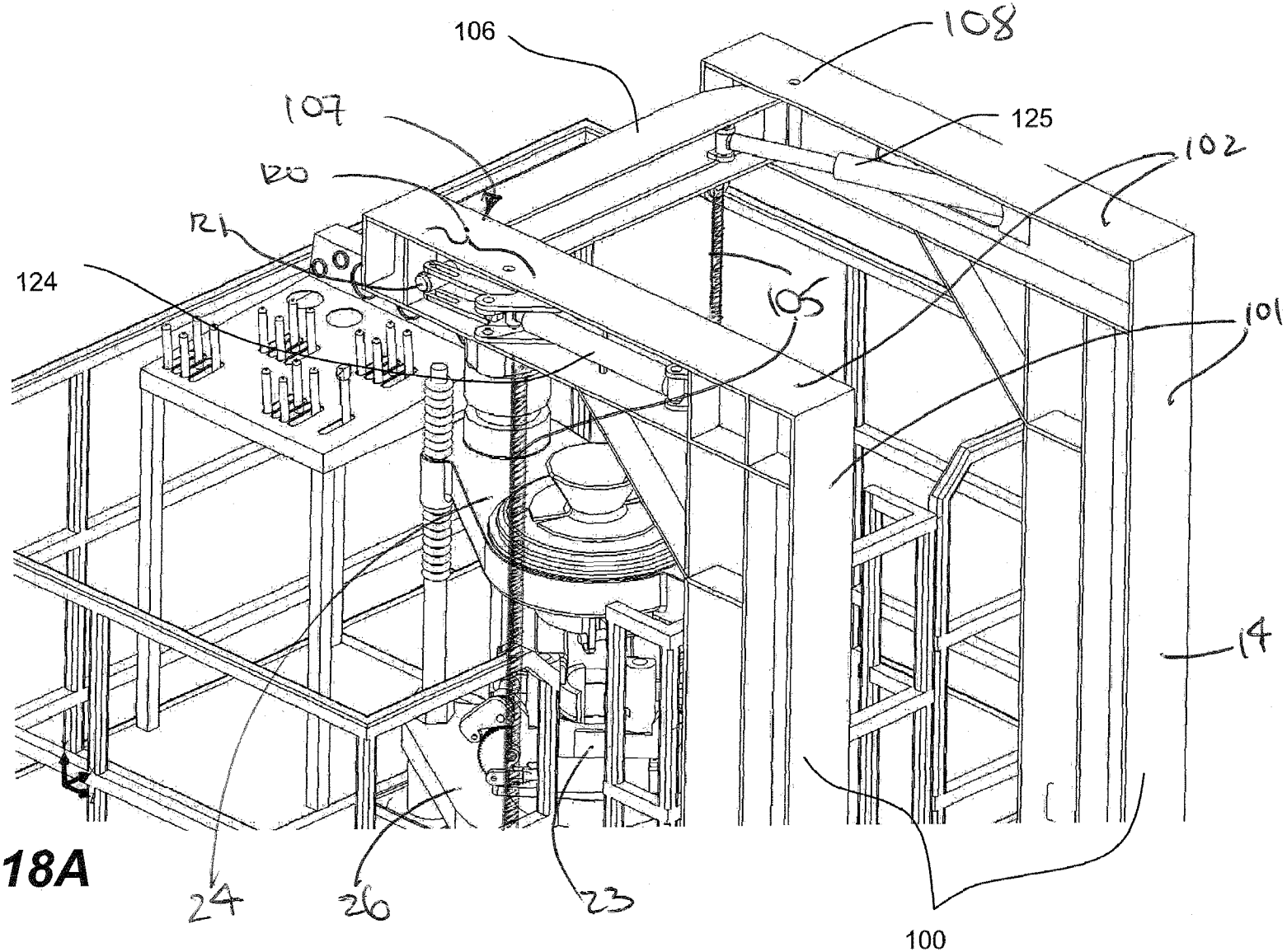
FIGS. 18A through 18D are partial perspective views of the L-frame with the axis beam member in various modes of operation (the tongs being shown in dotted lines). More particularly.

Also referring to FIGS. 3 and 5, in the raised operational position, the snubbing unit 11 is suspended thereunder for alignment over the wellhead 13. In FIG. 18A, cables 105 extend between the L-frame 14 and the traveling plate 26 of the snubbing unit 11 for suspending the snubbing unit 11 thereunder. Actuation of the traveling plate 26 vertically manipulates the snubbing unit 11 position under the L-frame 14. For example, lifting actuation of the traveling plate 26 lowers the snubbing unit 11 towards the wellhead 13. Once settled on the wellhead 13 and connected such as by bolts thereto, the cables 105 can be disconnected from the traveling plate 26 and tied off out of the way for subsequent snubbing operations.

Optionally, once supported on the wellhead 13, the dead load of the snubbing unit 11 can be relieved from the wellhead 13 using tension devices such as chains and boomers between the snubbing unit 11 and the L-frame 14. Further, once the snubbing unit 11 is supported on the wellhead 13, the L-frame 14 can be tipped to reside adjacent the snubbing unit 11. The snubbing unit 11 can then be secured to the L-frame 14 for further stability.

As shown in FIGS. 18A-18D, the legs 101 of the L-frame 14 are secured together during lifting of the snubbing unit 11 through a releasable and movable axis beam member 106. The movable axis beam 106 extends laterally across the arms 102 of the L-frame 14, which ties the arms 102 and legs 101 of the L-shaped members 100,100 together for increasing structure rigidity of the L-frame 14. Once the L-frame 14 has been raised upright, and the forces of raising the snubbing unit 11 are reduced, the snubbing unit 11 is hydraulically lowered onto and bolted to the wellhead 13 as described above.

Figure 18B:
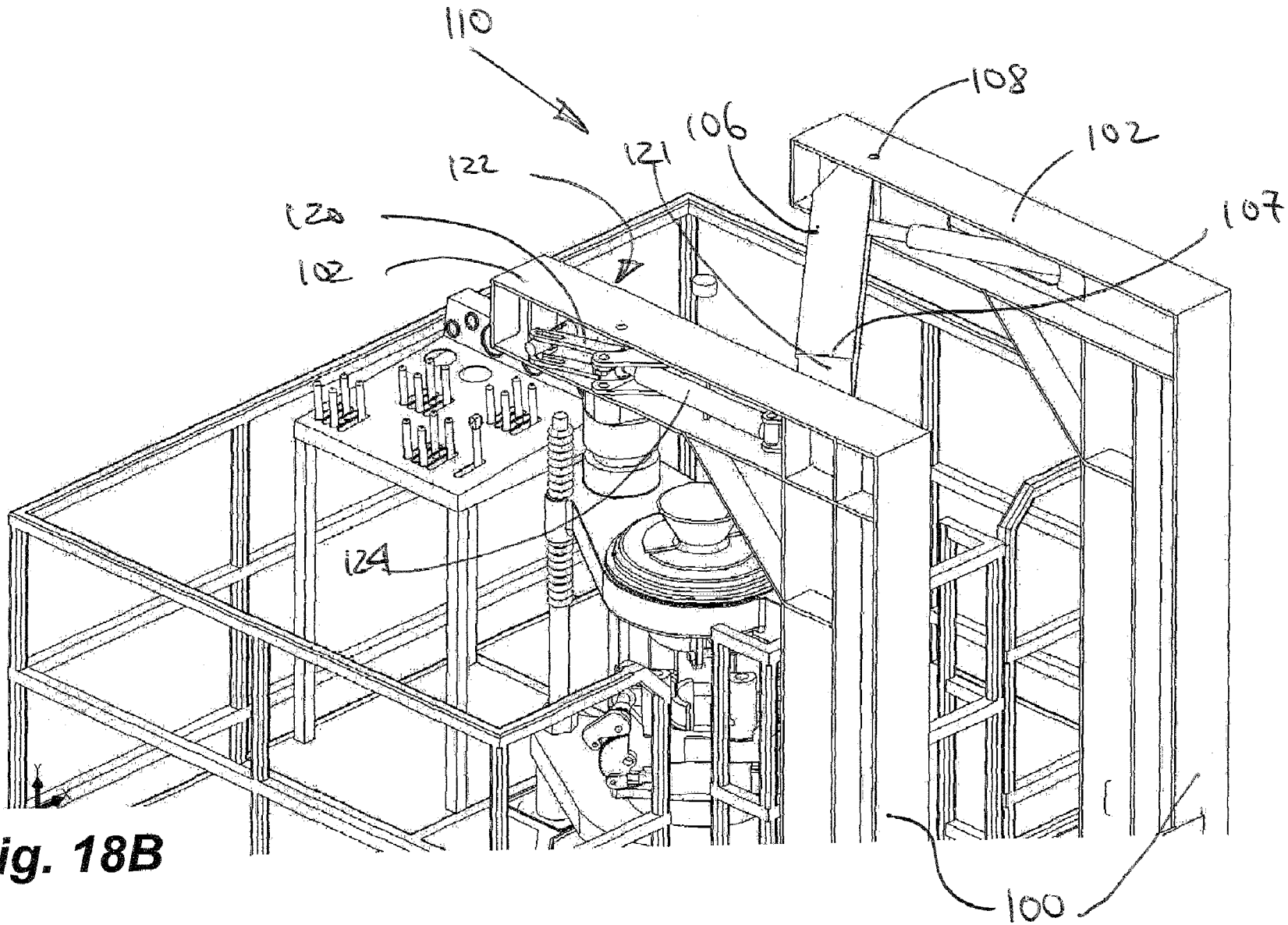
Figure 18C:
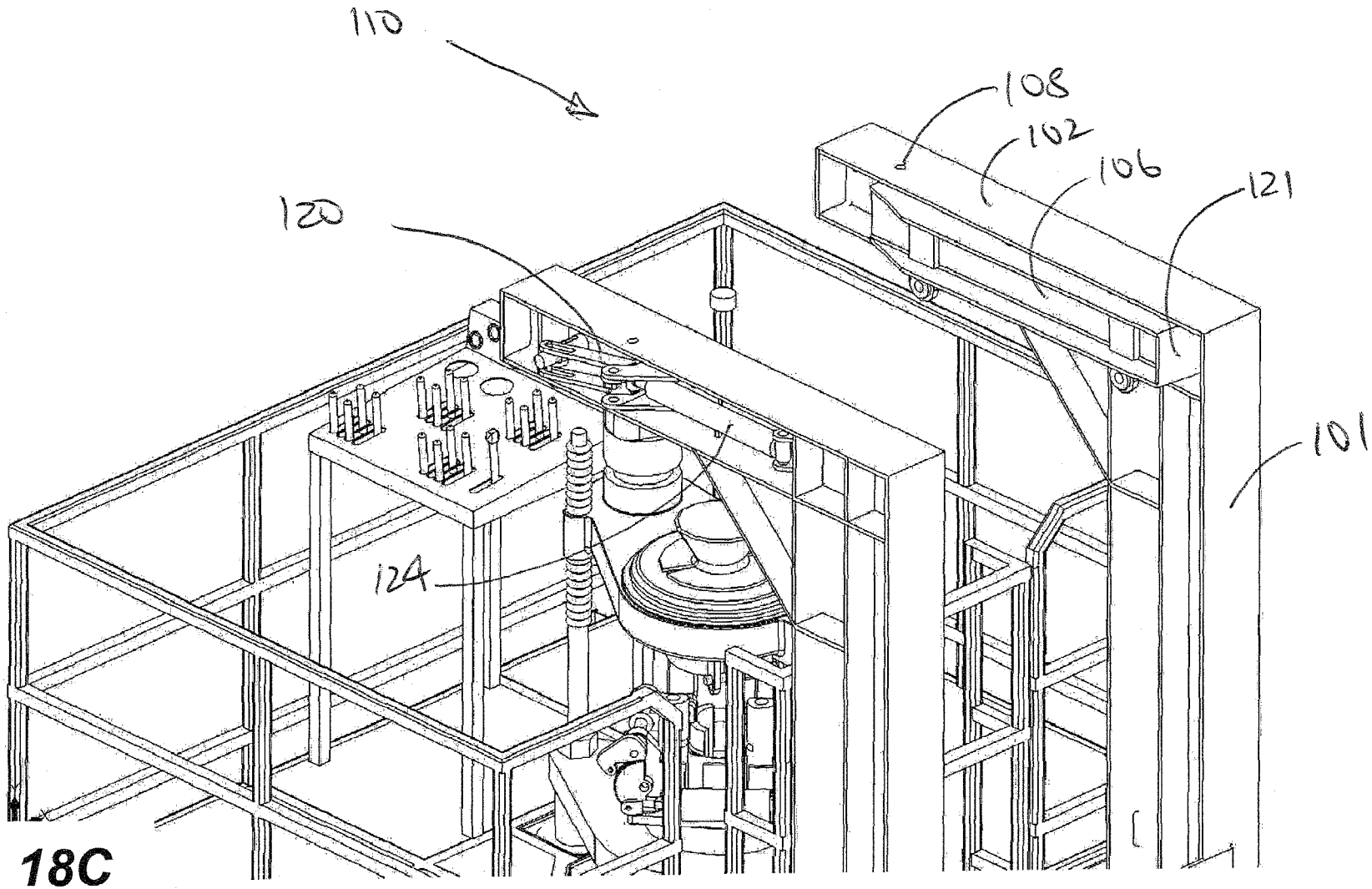
Figure 18D:
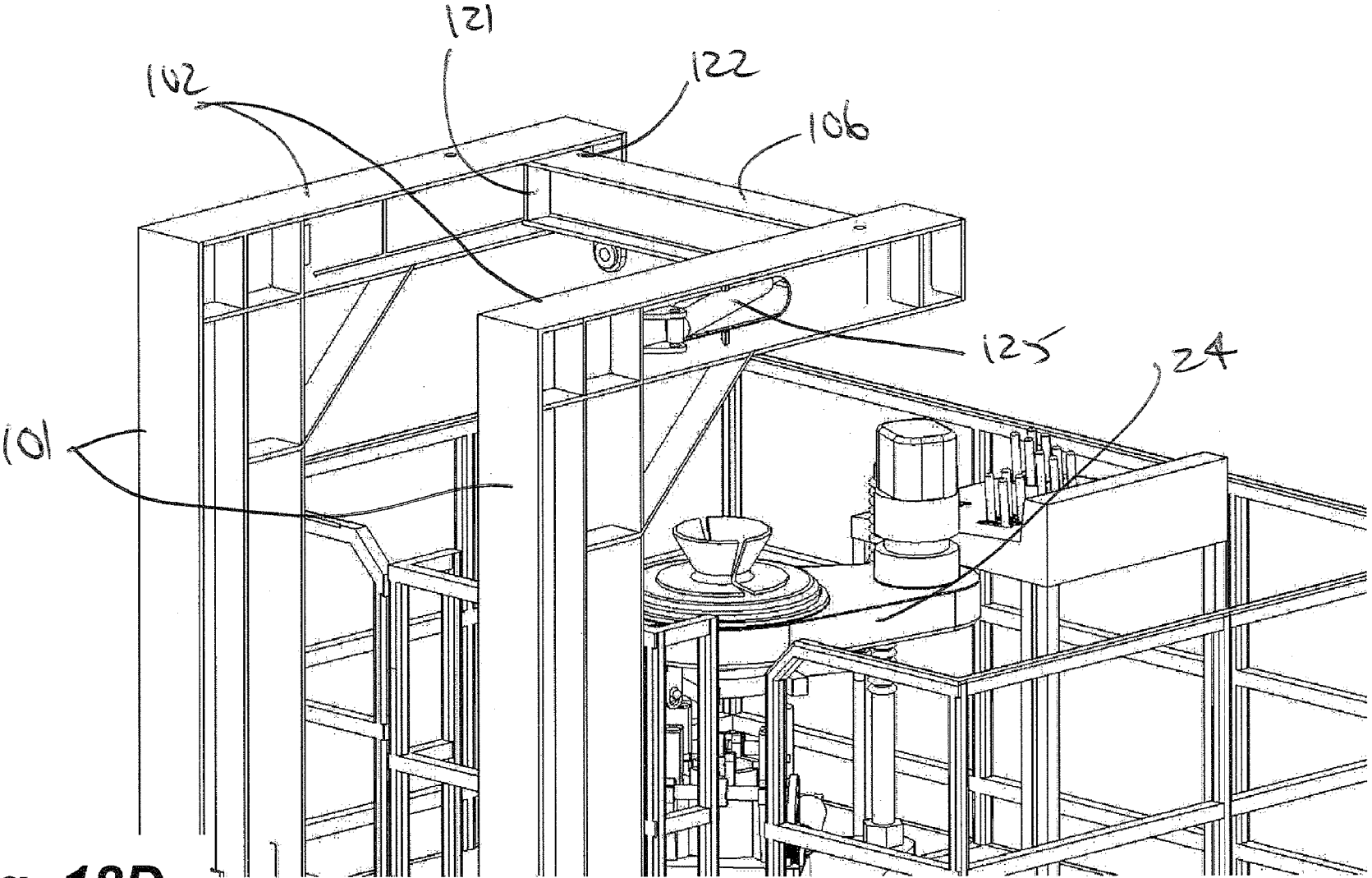

If FIGS. 18B-18D, once the cables 105 connecting the snubbing unit 11 to the axis beam 106 are removed, the beam 106 can be remotely released at one locking end 107 and pivoted at the other pivoting end 108 for opening the L-frame 14 into two upstanding L-shaped members 100,100 and forming an open side 110 for the passage of tubulars 21 therethrough, manipulated by the pipe handler 20 from a horizontal position at the truck equipment bed 33 to a substantially vertical position over the snubbing unit 11. As shown in FIG. 5, the traveling plate 26 and traveling slips 23 can pass upwardly between the L-shaped members 100,100 in operation.

The axis beam member 106 comprises a beam, such as an I-beam, which is pivotally connected at the pivot end 108 to one arm 102, and which has at the other locking end of the beam, a lock connection 120 to the other arm 102. The lock connection 120 is formed by the arrangement of an end plate 121 on the locking end 107 which engages a catch 122 (obscured) on one L-shaped member 100 so as to secure the L-shaped members 100,100 laterally together. To prevent pivotal release of the end plate 121 and catch 122, a pin 123 is releasably engaged through both the arm 102 supporting the locking connection 120 and the end plate 121. FIG. 18A illustrates the end plate 121 engaged, and FIGS. 18B-18D illustrate the end plate 121 disengaged. The movable axis beam 106 further comprises a pin-release actuator 124, such as a hydraulic ram, and a beam-pivoting actuator 125. For locking the axis beam 106, the beam-pivoting actuator 125 is actuated to rotate the axis beam 106 transverse and substantially perpendicular to the L-shaped members 100,100. The axis beam's end plate 121 engages the catch 122. Sensing engagement, such as through resistance or a pressure increase in a hydraulic actuator, the pin-release actuator 124 is actuated, securing the L-frame 14 as one. In reverse, to release the axis beam 106, the pin-release actuator 124 is first actuated to release the pin 123. Sensing disengagement of the pin 123 or through a range of motion of the actuator 124, such as through resistance or a pressure increase in a hydraulic-type actuator, then the beam-pivoting actuator 125 is actuated to swing the axis beam 106 out of the open side of the L-frame 14.

Snubbing Unit

Figure 29:
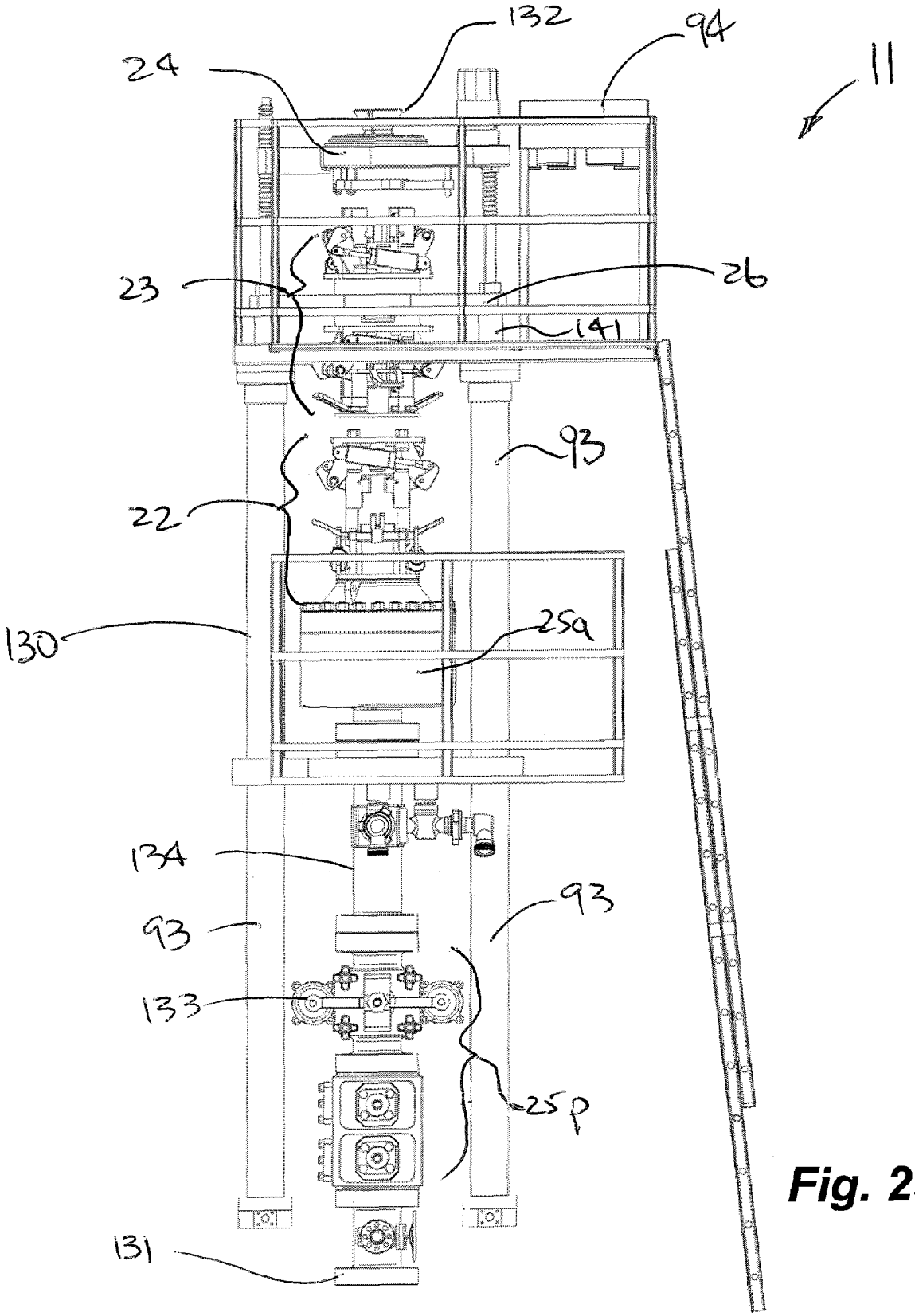
FIG. 29 is a view of an embodiment of the snubbing unit in isolation for detailing the preferred components.
Figure 30A:
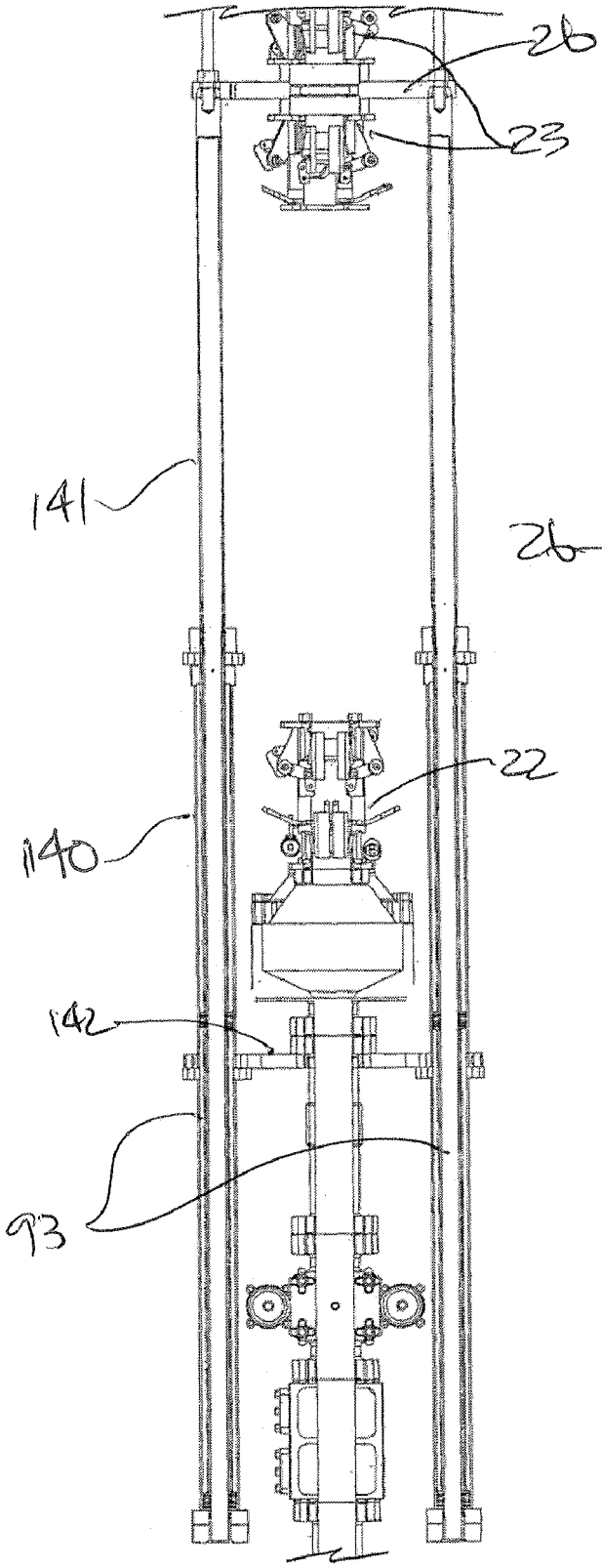
FIGS. 30A and 30B are operational views of the snubbing unit of FIG. 29 illustrating the actuators stroking operation with the traveling plate raised, and lowered respectively.
Figure 30B:
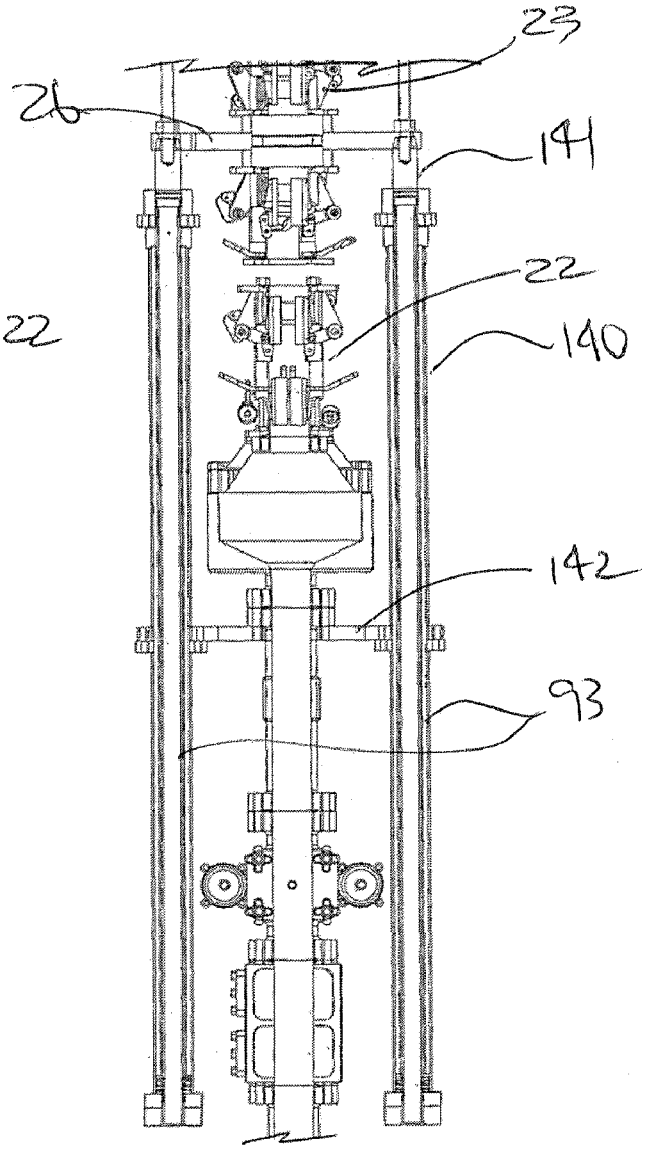

With reference to FIGS. 29, 30A and 30B, being a side view of the snubbing unit 11 in isolation from the mobile snubbing system 1, the snubbing unit 11 portion comprises a tubular snubbing structure 130 adapted for securing atop the wellhead 13 at a lower connection 131 such as an industry standard 3000 or 5000 psi flanged connection. The top of the wellhead 13 is represented by a conventional spool, however those of skill in the art understand that other components may exist, or could be provided as part of the snubbing unit 11. The wellhead 13 normally blocks the wellbore of a well (not shown) under pressure. The snubbing structure 130 can be pre-fit with double gate, primary blow out preventers (BOP) 25*p*. The snubbing unit 11 employs a lower, stationary slip assembly 22 and an upper, traveling slip assembly 23 for releasably and controllably shifting tubulars 21 along a common axis through the tubular snubbing structure 130 and the wellhead 13 below. The tubular snubbing structure 13 has a working bore which is open to communicate with the wellbore. Typically, the tubular snubbing structure 130 also incorporates an annular BOP 25*a*. The traveling slip assembly 23 is supported on the traveling plate 26 which is raised and lowered on at least two hydraulic actuators 93,93. A pair of hydraulic actuators 93,93 is shown to impart or receive snubbing loads from the traveling plate 26 to the tubular snubbing structure 130, and to the wellhead 13. In an alternate version, the traveling plate 26 can be fitted with hydraulic motors and pinion gears which drive the traveling plate 26 up or down rack columns suspended from a mast or derrick.

The structure about the traveling plate 26 and traveling slips 23 can also incorporate an accepting cone 132 for guiding the ends of tubulars 21 into the snubbing structure 130 and tongs 24 for making and breaking threaded joints. Additional operational features located between the wellhead 13 and the stationary slip assembly 22 comprises: primary well control BOP's 25*p*, a stripping pipe ram 133, and a working or load spool 134. The height of the load spool 134 is sized to provide working space between the stripping annular BOP 25*a* above the stripping pipe ram 133 for housing and removal of tubulars 21 such as a bottom hole assembly (BHA) from the wellhead 13.

As shown in FIGS. 30A and 30B, each of the hydraulic actuators 93,93 comprise a cylinder 140 and a rod 141. The cylinders 140 are spaced laterally from and parallel to the common axis of the tubular snubbing structure 130. The cylinders 140 are mounted to load members 142 which extend from the load spool 134 of the tubular snubbing structure 130. The rods 141 are mounted to the traveling plate 26. Hydraulics raise and lower the rods 141 relative to the cylinders 140, thereby raising and lowering the traveling plate 26 and traveling slip assembly 23 relative to the stationary slip assembly 22. The cylinders 140 are mounted to the load members 142 somewhere intermediate along their length, and preferably about midway therealong, thereby positioning the traveling slip assembly 23 in close proximity to the stationary slip assembly 22 when fully retracted to a lowered position. Further, such spacing enables maximum stroke with a minimum overall height of the snubbing unit 11 while maintaining suitable stability. The hydraulic actuators 93 are operated to reciprocate the traveling slip assembly 23 between a raised position (FIG. 30A) and a lowered position (FIG. 30B).

Testing of the BOP Stack

Figure 28:
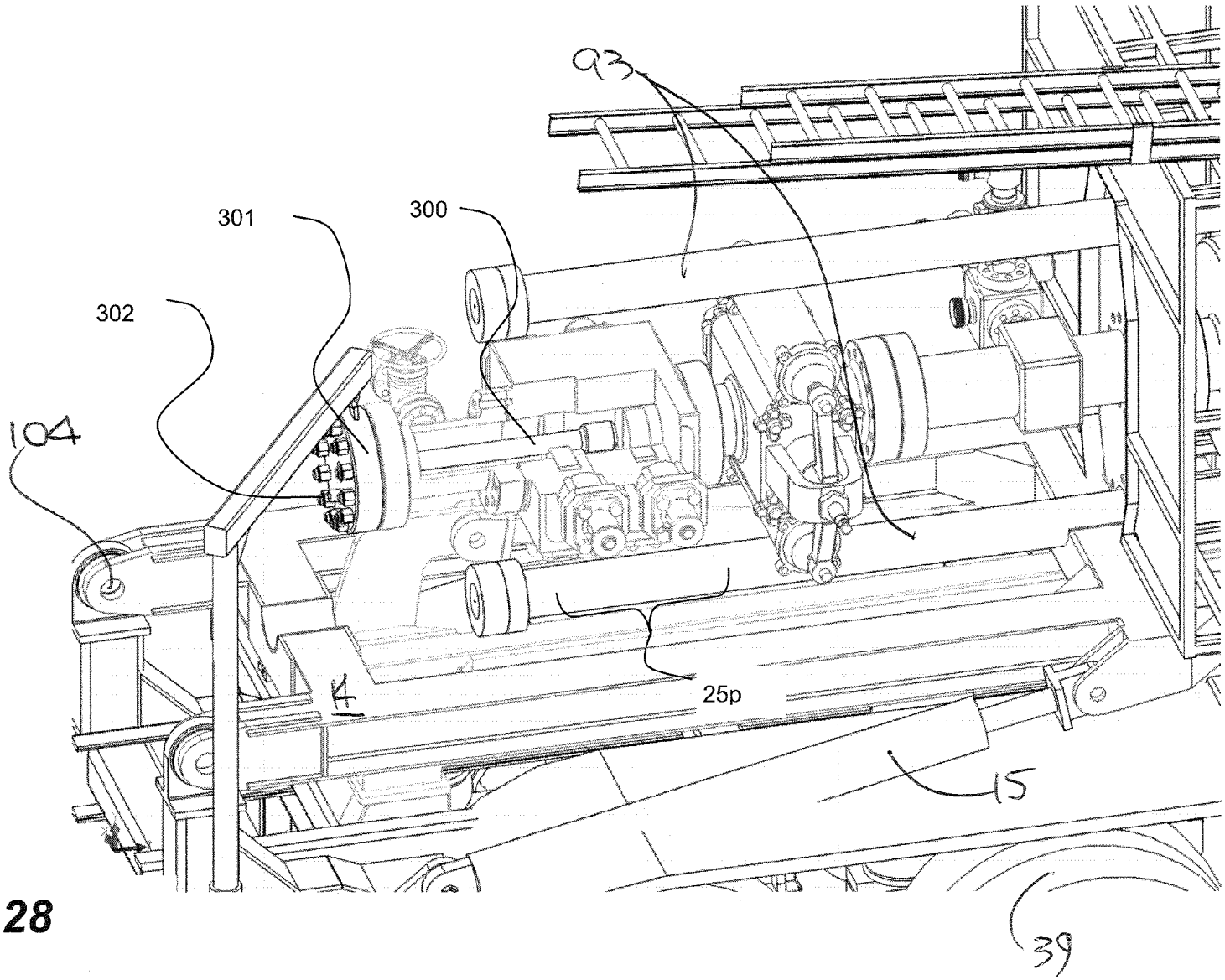
FIG. 28 illustrates a partial cutaway cross-sectional perspective view of the primary BOP of the snubbing unit with the nubbin and dummy testing flange installed.

With reference to FIG. 28, in another embodiment of the invention, the BOP stack can be pressure tested before nippling up.

The truck equipment bed 33 further comprises a fluid reservoir and pumping system. Fluid such as antifreeze can be pumped into the primary BOP 25*p* stack to simulate annular pressure about dummy tubing inserted in the BOP stack.

While the snubbing unit 11 is in the shipping position, a nubbin 300 or blank of dummy tubing sized for the tubing rams in the primary BOP 25 is fit into the BOP stack. The appropriate sized nubbin 300 is secured to a flange 301, such as being threaded into the flange 301, and is adapted for connection to the terminal flange at the bottom of the snubbing unit 11. The flange 301 is connected to the BOP stack for sealing the annular space. The terminal flange of the snubbing unit 11 is the conventional point of connection to a wellhead flange onsite.

The dummy flange has an offset port 302 for fluid communication between a fluid pump source and the sealed annular space. Actuation of the various BOP's can be tested with application of pressurized fluid to the annulus. The dummy flange is oriented with the offset port adjacent the bottom and with the extreme radial extent of the annular space so as to enable complete removal of the fluids after the testing is complete.

The embodiments of the invention for which an exclusive property or privilege is claimed are defined as follows:

1. A mobile snubbing system for manipulating tubulars into and out of a wellhead through a wellhead axis comprising:

a snubbing unit having a snubbing axis, a top end and a bottom end adapted to connect to the wellhead;

a mobile transport platform for delivering the snubbing unit to the wellhead, the platform having a front end and a rear end and an open side;

a frame having a first end mounted pivotally at the rear end of the platform and a second end, the frame being pivotally actuated from the platform and operable between a first shipping position, wherein the snubbing unit is supported by the frame with the snubbing axis generally horizontal, and a second operational position, wherein the frame is pivotally erected about the first end of the frame for aligning the snubbing axis of the snubbing unit with the wellhead axis of the wellhead for connection thereto; and a pipe handler having a boom pivotally mounted at a first end of the boom adjacent the rear end of the platform wherein when the frame is in its second operational position, the boom is operable between a first platform position substantially parallel to the platform for loading and off-loading tubulars at the open side, and a second snubbing position, wherein the boom is pivotally erected for loading and off-loading tubulars at the top end of the snubbing unit.

2. The system of claim 1 wherein a distal end of the boom is telescoping along a boom axis.

3. The system of claim 1 further comprises a controller for manipulating a guided tubular between the platform and snubbing positions.

4. The system of claim 3 wherein the controller manipulates at least the rotation of the pivoting boom.

5. The system of claim 1 wherein the pipe handler further comprises a pipe carriage for releasably handling the tubulars, the pipe carriage being mounted pivotally to the distal end of the boom.

6. The system of claim 5 further comprises a controller for manipulating a guided tubular between the platform and snubbing positions, the controller manipulating at least the rotation of the pivoting boom, the extension of the extendible boom and rotation of the pivoting pipe carriage.

7. The system of claim 3 wherein the controller operates between a first learning state wherein the guided tubular is manually guided between the platform and snubbing positions and a second automatic state, wherein the controller thereafter applies the first learning state for automatically guiding the guided tubular between the platform position and the snubbing position.

8. The system of claim 5 wherein the pipe carriage further comprises at least two automated clamps spaced therealong, at least one of which having gripping teeth to provide a gripping surface for gripping tubulars.

9. The system of claim 8 wherein the at least two pipe clamps can be manipulated along the carriage for manipulating a gripped tubular.

10. The system of claim 1 further comprising suspending connectors between the snubbing unit and the second end of the frame, wherein when the frame is in its second operational position, the snubbing unit is suspended along the wellhead axis.

11. The system of claim 10 wherein the suspended snubbing unit is vertically movable along the wellhead axis.

12. The system of claim 10 wherein:

the snubbing unit further comprises a vertically actuable traveling plate; and the suspending connectors are connected between the frame and the traveling plate for vertically moving the snubbing unit over the wellhead.

13. The system of claim 12 wherein the traveling plate is vertically actuable using hydraulic actuators.

14. The system of claim 12 wherein the traveling plate is vertically actuable using rack and pinion drive.

15. The system of claim 12 wherein the frame further comprises:

at least two spaced support members extending from the first end to the second end; and an axis beam member at the second end of the frame and extending between the at least two spaced members, the axis beam member being substantially aligned over the snubbing axis, wherein the suspending connectors are connected between the axis beam member and the snubbing unit.

16. The system of claim 15 wherein the axis beam member further comprises a first end pivotally mounted to one of the at least two spaced members and being operable between a first closed position substantially aligned over the snubbing axis and extending between the at least two spaced members; and a second open position for opening the frame between the at least two spaced members for access to the top end of the snubbing unit.

17. The system of claim 16 further comprising tension devices extending between at least one of the at least two spaced members at the second end of the frame and the snubbing unit wherein when the axis beam member is in its second open position, the snubbing unit is at least partially supported from the frame.

18. The system of claim 17 wherein the axis beam member is secured in its first closed position by a lock connection at a second end of the axis beam member to one of the at least two support members.

19. The system of claim 18 wherein the pivoting of the axis beam member and lock connection are hydraulically actuated.

20. The system of claim 1 further comprising pipe racks for loading and off-loading tubulars at the open side of the platform, the pipe racks being operable between a first traveling position stowed parallel to the open side of the platform and a second operational position wherein the pipe racks are substantially perpendicular to the platform.

21. The system of claim 20 wherein the pipe racks load and off-load tubulars at the open side of the platform for the pipe handler.

22. The system of claim 20 wherein the pipe racks are pivotally mounted at a first end to the platform for swinging between the first traveling position and the second operational position.

23. The system of claim 22 wherein the pipe racks further comprise:

a first pipe rack arm having an outboard end and being pivotally mounted at a mounting end at about a front of the platform, and a second pipe rack arm having an outboard end and being pivotally mounted at a mounting end at about the rear of the platform, wherein, the outboard end of the first pipe rack arm is deployable from the first traveling position at about the rear of the platform, and the outboard end of the second pipe rack arm is deployable from the first traveling position at about the front of the platform.

24. The system of claim 23 wherein the first and second pipe rack arms further comprise actuators at their outboard ends for adjusting the angle of the pipe racks for loading or off-loading tubulars to or from the open side.

25. The system of claim 1 further comprising an indexer and a kicker and wherein with the pipe handler is in the platform position, the indexer loads tubulars one at a time to the pipe handler and the kicker off-loads tubulars from the pipe handler.

26. The system of claim 1 wherein:

the snubbing unit further comprises blow out preventor (BOP) gates and a terminal flange at the bottom end;

a nubbin sized to the BOP gates for forming an annular space therebetween when fit to the BOP gates, the nubbin being secured to a testing flange for sealable connection to the terminal flange, wherein application of pressurized testing fluid through the testing flange to the annular space tests the BOP gates.

27. The system of claim 1 wherein said mobile transport platform is a cab-over truck.

28. A method for snubbing a well having a wellhead and a wellhead axis, the method comprising:

supporting a snubbing unit in a frame which is supported by a mobile platform;

transporting the frame and snubbing unit to the wellhead by the mobile platform;

pivoting the frame about a wellhead end of the platform for suspending a snubbing axis of the snubbing unit in alignment with the wellhead axis;

connecting the snubbing unit to the wellhead;

loading and off-loading tubulars from an open side of the platform; and pivoting a pipe handler from the platform for handling the tubulars between a platform position for loading and off-loading tubulars and a snubbing position for loading and off-loading tubulars at the snubbing unit for snubbing the well.

29. The method of claim 28 wherein the pivoting of the pipe handler further comprises:

controlling the pipe handler comprising manually guiding a tubular between the platform and the snubbing unit for learning a movement of tubulars for snubbing the well; and thereafter automatically pivoting tubulars between the platform and the snubbing unit for snubbing the well.

30. The method of claim 28 further comprising:

receiving a tubular presented to the platform;

indexing the presented tubular from the platform to the pipe handler at the platform position; and pivoting the pipe handler from the platform between the platform and the snubbing position for loading the presented tubulars at the snubbing stack for snubbing the well.

31. The method of claim 28 further comprising:

receiving a tubular presented to the pipe handler at the snubbing position;

pivoting the pipe handler from the snubbing position to the platform position for off-loading the presented tubulars to the platform; and kicking the presented tubular from the pipe handler at the platform position for off-loading the tubular from the platform.

32. The method of claim 28 wherein the length of the platform is constrained and the pipe handler is telescopic, further comprising:

telescopically constraining the pipe handler to load or off-load a tubular at the platform; and telescopically extending the pipe handler to load or off-load a tubular at the snubbing unit.

33. The method of claim 28 wherein prior to pivoting the pipe handler for snubbing the well, further comprising:

swinging a front pipe rack from a stowed position on the platform to an operation position substantially perpendicular to the platform;

swinging a rear pipe rack from a stowed position on the platform to an operation position substantially perpendicular to the platform; and loading and off-loading tubulars to and from the platform and pipe handler along the front and rear pipe racks.

34. A mobile snubbing system for manipulating tubulars into and out of a wellhead through a wellhead axis comprising:

a snubbing unit having a snubbing axis, a top end and a bottom end adapted to connect to the wellhead;

a mobile transport platform for delivering the snubbing unit to the wellhead, the platform having a front end and a rear end;

a frame having a first end mounted pivotally at the rear end of the platform and a second end, the frame being operable between a first shipping position, wherein the snubbing unit is supported by the frame with the snubbing axis generally horizontal, and a second operational position, wherein the frame is pivotally erected about the first end of the frame for aligning the snubbing axis of the snubbing unit with the wellhead axis of the wellhead for connection thereto;

a pipe handler having a boom pivotally mounted at a first end of the boom adjacent the rear end of the platform wherein when the frame is in its second operational position, the boom is operable between a first platform position substantially parallel to the platform for loading and off-loading tubulars, and a second snubbing position, wherein the boom is pivotally erected for loading and off-loading tubulars at the top end of the snubbing unit; and a controller for manipulating the pipe handler between the platform and snubbing positions and wherein the controller operates between a first learning state wherein the controller is manually guided between the platform and snubbing positions and a second automatic state, wherein the controller thereafter applies the first learning state for automatically operates the pipe handler between the platform position and the snubbing position.

35. The system of claim 34 further comprising an indexer and a kicker and wherein with the pipe handler is in the platform position, the indexer loads tubulars one at a time to the pipe handler and the kicker off-loads tubulars from the pipe handler.

36. The system of claim 34 further comprising pipe racks for loading and off-loading tubulars at an open side of the platform, the pipe racks being operable between a first traveling position stowed parallel to the open side of the platform and a second operational position wherein the pipe racks are substantially perpendicular to the platform.

* * * * *